US007231944B2

(12) United States Patent
Magno, Jr. et al.

(10) Patent No.: US 7,231,944 B2
(45) Date of Patent: Jun. 19, 2007

(54) TENSION AND ANTI-RECOIL MECHANISM FOR CABLE TIE TOOL

(75) Inventors: Joey D. Magno, Jr., Cordova, TN (US); Johan Tapper, Hedemora (SE); Anders Fahlen, Skedvi (SE); Joakim Norin, Stockholm (SE); Goran Paulsson, Mora (SE); Sven Wadling, Smedjebacken (SE)

(73) Assignee: Thomas & Betts International, Inc., Wilmington, DE (US)

( * ) Notice: Subject to any disclaimer, the term of this patent is extended or adjusted under 35 U.S.C. 154(b) by 121 days.

(21) Appl. No.: 11/056,078

(22) Filed: Feb. 11, 2005

(65) Prior Publication Data

US 2005/0178461 A1 Aug. 18, 2005

Related U.S. Application Data

(60) Provisional application No. 60/544,361, filed on Feb. 13, 2004.

(51) Int. Cl.
*B21F 9/00* (2006.01)
*B21F 9/02* (2006.01)

(52) U.S. Cl. ..... 140/123.6; 140/93.2

(58) Field of Classification Search ..... 140/123.6, 140/93.2

See application file for complete search history.

(56) References Cited

U.S. PATENT DOCUMENTS 3,157,361 A 11/1964 Heard
3,633,633 A * 1/1972 Countryman ..... 140/93.2
3,735,784 A 5/1973 Obuch
3,853,155 A * 12/1974 Kabel ..... 140/123.6
3,865,156 A 2/1975 Moody et al.
4,047,545 A 9/1977 Paradis
4,083,497 A 4/1978 Rosenberger
4,093,005 A 6/1978 Eberhardt et al.

(Continued)

FOREIGN PATENT DOCUMENTS

EP 0 299 387 A 1/1989

(Continued)

OTHER PUBLICATIONS

U.S. Appl. No. 29/185,986, filed Jul. 7, 2003, Magno, Jr. et al., USPTO Filing Receipt, specification and drawings.

(Continued)

*Primary Examiner*—Lowell A. Larson
*Assistant Examiner*—Teresa M. Bonk
(74) *Attorney, Agent, or Firm*—Hoffmann & Baron, LLP

(57) ABSTRACT

The tension and anti-recoil mechanism of the present invention is connected to a tool handle of a cable tie tool. The tool handle has a barrel and a grip depending therefrom. The tension and anti-recoil mechanism includes a regulator grip supported in the barrel. A one-piece cutter actuator is supported in the regulator grip for longitudinal displacement relative to the barrel. A tension limiting mechanism directs a retaining force against the cutter actuator to resist longitudinal displacement thereof relative to the barrel. The retaining force may be controlled to limit the tension produced in a cable tie prior to severing the strap thereof. Recoil of the cable tie tool which may result from the severing is substantially limited by the tension and anti-recoil mechanism.

10 Claims, 20 Drawing Sheets

U.S. PATENT DOCUMENTS

| | | | | | |
|---|---|---|---|---|---|
| RE29,973 | E | | 4/1979 | Paradis | |
| 4,192,358 | A | | 3/1980 | Bone | |
| 4,410,019 | A | | 10/1983 | Suzuki | |
| 4,534,817 | A | | 8/1985 | O'Sullivan | |
| 4,548,242 | A | | 10/1985 | Paradis | |
| 4,609,149 | A | | 9/1986 | Jessen | |
| 4,718,460 | A | | 1/1988 | Sato | |
| 4,726,403 | A | | 2/1988 | Young et al. | |
| 4,791,968 | A | | 12/1988 | Pearson | |
| 4,793,385 | A | | 12/1988 | Dyer et al. | |
| D306,390 | S | | 3/1990 | Dyer | |
| 4,997,011 | A | | 3/1991 | Dyer et al. | |
| 5,000,232 | A | * | 3/1991 | Wolcott | 140/123.6 |
| 5,123,456 | A | * | 6/1992 | Jansen | 140/123.6 |
| 5,176,327 | A | | 1/1993 | Petersen et al. | |
| 5,392,822 | A | | 2/1995 | Kraus | |
| 5,431,659 | A | | 7/1995 | Ross, Jr. et al. | |
| 5,492,156 | A | | 2/1996 | Dyer et al. | |
| 5,518,043 | A | | 5/1996 | Cheung et al. | |
| D370,962 | S | | 6/1996 | Aquilina | |
| 5,566,726 | A | | 10/1996 | Marelin | |
| 5,595,220 | A | | 1/1997 | Leban et al. | |
| 5,667,143 | A | | 9/1997 | Sebion et al. | |
| 5,769,133 | A | | 6/1998 | Dyer et al. | |
| 5,832,964 | A | | 11/1998 | Joshi | |
| 5,915,425 | A | | 6/1999 | Nilsson et al. | |
| 6,039,089 | A | | 3/2000 | Kurmis | |
| 6,047,741 | A | | 4/2000 | Kurmis | |
| D430,781 | S | | 9/2000 | Hillegonds | |
| 6,206,053 | B1 | | 3/2001 | Hillegonds | |
| 6,513,555 | B1 | | 2/2003 | Lesser et al. | |
| D491,430 | S | | 6/2004 | Magno, Jr. et al. | |
| 2005/0005993 | A1 | | 1/2005 | Magno, Jr. et al. | |

FOREIGN PATENT DOCUMENTS

| | | | |
|---|---|---|---|
| EP | 0 299 387 | A1 | 1/1989 |
| EP | 1 108 649 | | 6/2001 |
| EP | 1 564 145 | A1 | 8/2005 |
| GB | 1577957 | | 10/1980 |
| GB | 2 240 601 | A | 8/1991 |
| JP | 2000-168724 | | 6/2000 |
| JP | 2000 168724 | | 6/2000 |
| JP | 2002 321705 | | 11/2002 |

OTHER PUBLICATIONS

Fiskars, "PowerGear Bypass Pruner", The Home Depot, before May 20, 2003 (approximately Feb. 2003), enlargement of illustration.

Fiskars, "Ergonomics, The Development of Vineyard Cutting Tools", Aug. 29, 2003.

Partial European Search Report for European Patent Application No. EP 05 07 5328, including Annex, Abstract, Lack of Unity of Invention-Sheet B dated Jun. 9, 2005 (4 pages).

European Search Report for European Patent Application No. EP 04 25 3852, including Annex, attached to European Patent Office Communication dated Jan. 21, 2005 (5 pages).

European Search Report for European Patent Application No. EP 05 07 5328, including Lack of Unity of Invention (Sheet B), Annex, and Abstract, attached to European Patent Office Communication dated Sep. 21, 2005 (6 pages).

"Communication pursuant to Article 96(2) EPC", European Patent Office, European Patent Application No. 04 253 852.0—1261, Jun. 7, 2006 (4 pages).

"Notification of Reason for Refusal", Japanese Patent Office, Japanese Patent Application No. 2004-200020, Dec. 19, 2005 (Japanese language, 2 pages, English language translation, 1 page).

Office communication, U.S. Patent and Trademark Office, U.S. Appl. No. 10/614,435, Sep. 26, 2005 (13 pages).

Office communication, U.S. Patent and Trademark Office, U.S. Appl. No. 10/614,435, Jun. 28, 2006 (5 pages).

PCT Notification of Transmittal of the International Search Report and the Written Opinion of the International Searching Authority, or the Declaration for International Application No. PCT/US2005/009319, Jul. 6, 2005 (3 pages).

PCT International Search Report for International Application No. PCT/US2005/009319, Jul. 6, 2005 (4 pages).

PCT Written Opinion of the International Searching Authority for International Application No. PCT/US2005/009319, Jul. 6, 2005 (4 pages).

Office Action, Canadian Intellectual Property Office, Canadian Patent Application No. 2,471,183, Jun. 28, 2006 (3 pages).

European Search Report (including Annex) for European Application No. 05 07 5329, May 12, 2005 (4 pages).

* cited by examiner 10
92
85
132
90
50
83
32
222
226
224
41
12
7
157
147
61
75
86
87
63
65
66
67
27
201
215
203
217
35
43
47
220
226
22
37
25
45
39

TENSION AND ANTI-RECOIL MECHANISM FOR CABLE TIE TOOL

CROSS-REFERENCE TO RELATED APPLICATION

This patent application claims priority to and the benefit of U.S. Provisional Patent Application No. 60/544,361 filed in the U.S. Patent and Trademark Office (USPTO) on Feb. 13, 2004.

BACKGROUND OF THE INVENTION

The present invention relates generally to a tension and anti-recoil mechanism for a cable tie tool, and more specifically, to such a mechanism for limiting the tension applied to the cable tie by the tool and limiting the re-coil of the tool when the cable tie is cut.

Cable ties are used to bundle or secure a group of articles such as electrical wires or cables. Cable ties of conventional construction include a cable tie head and an elongate strap extending therefrom. The strap is wrapped around a bundle of articles and thereafter inserted through a passage in the head. The head of the cable tie typically supports a locking element which extends into the head passage allowing the strap to be inserted through the passage but preventing retraction of the strap through the passage in the head. Two longitudinally separated portions of the strap are thereby secured to the head to define a loop for holding together the group of articles.

In use, the installer manually places the tie about the articles to be bundled, inserts the strap through the head passage and then manually tightens the tie about the bundle. Further tightening of the cable tie, which increases the tension in the strap thereof, may be provided by a cable tie tool.

One type of such a cable tie tool includes a housing which is generally pistol-shaped where the housing has a barrel into which the strap may be inserted for application of the tension. The housing has a grip which depends from the barrel. The cable tie tool may have a mechanism for limiting the tension force which is applied to the strap of the cable tie and for cutting the strap of the cable tie when the maximum tension is applied to the strap. Such cutting of the strap may resulting a re-coil force being applied to the hand of the user. The magnitude of this re-coil force may be limited by a mechanism in the cable tie tool. Such a mechanism for limiting the tension force applied to the strap of the cable tie and for limiting the re-coil force may increase the complexity and size of the cable tie tool.

SUMMARY OF THE INVENTION

The tension and anti-recoil mechanism of the present invention is incorporated in a cable tie tool. The tension and anti-recoil mechanism limits the tension applied to the cable tie by the tool and limits the re-coil of the tool when the cable tie is cut.

The cable tie tool, in which the tension and anti-recoil mechanism is incorporated, also has a tool handle provided with a barrel and a grip depending therefrom. The tension and anti-recoil mechanism includes a regulator grip which is supported in the barrel.

A one-piece cutter actuator is supported in the regulator grip for longitudinal displacement relative to the barrel. The cutter actuator and is coupled provides support to numerous components. The one-piece structure of the cutter actuator provides a single member to which such coupling and support is directed thereby simplifying the assembly and disassembly of the tension and anti-recoil mechanism.

A tension limiting mechanism directs a retaining force against the cutter actuator to resist longitudinal displacement thereof relative to the barrel. The retaining force is provided by a pair of blade springs located longitudinally between the front and rear ends of the cutter actuator. The longitudinal location of the blade springs between the front and rear ends of the cutter actuator facilitates longitudinal compactness of the tool head since the longitudinal portion thereof in which the cutter actuator is situated may also provide the location for the blade springs. The tension limiting mechanism provides for longitudinal displacement of the fulcrum of the blade springs to enable adjustment the retaining force.

The cutter actuator has a forward slot and longitudinal passage through which a pull rod extends. Supported by the cutter actuator within the forward slot is at least one lock washer. The lock washer is moveable between a released position which allows displacement of the pull rod relative to the cutter actuator, and a locked position in which such relative displacement is prevented. When in the released position, the lock washer abuts against a front ring. The front ring is located within the regulator grip. This facilitates assembly of the tension and anti-recoil mechanism, and handling thereof apart from the cable tie tool because the front ring is protected from separation from the tension and anti-recoil mechanism by the cutter actuator being within the regulator grip. The cutter actuator normally remains within the regulator grip even during partial disassembly, such as removal of the tension and anti-recoil mechanism from the tool handle.

A cutter actuator spring is located within a chamber between the regulator grip and cutter actuator. The cutter actuator spring resists longitudinal displacement of the cutter actuator in the rearward direction relative to the regulator grip. The location of the cutter actuator spring between the regulator grip and cutter actuator facilitates assembly of the spring to the cable tie tool since the spring is contained within the tension and anti-recoil mechanism and is therefore assembled to the tool handle with the tension and anti-recoil mechanism. Accordingly, the cutter actuator spring is not required to be assembled to a part of the cable tie tool, apart from the tension and anti-recoil mechanism, such as the tool handle.

These and other features of the invention will be more fully understood from the following description of specific embodiments of the invention taken together with the accompanying drawings.

BRIEF DESCRIPTION OF THE DRAWINGS

In the drawings.

Corresponding reference characters indicate corresponding parts throughout the several views of the drawings.

DETAILED DESCRIPTION OF THE INVENTION

Figure 2:
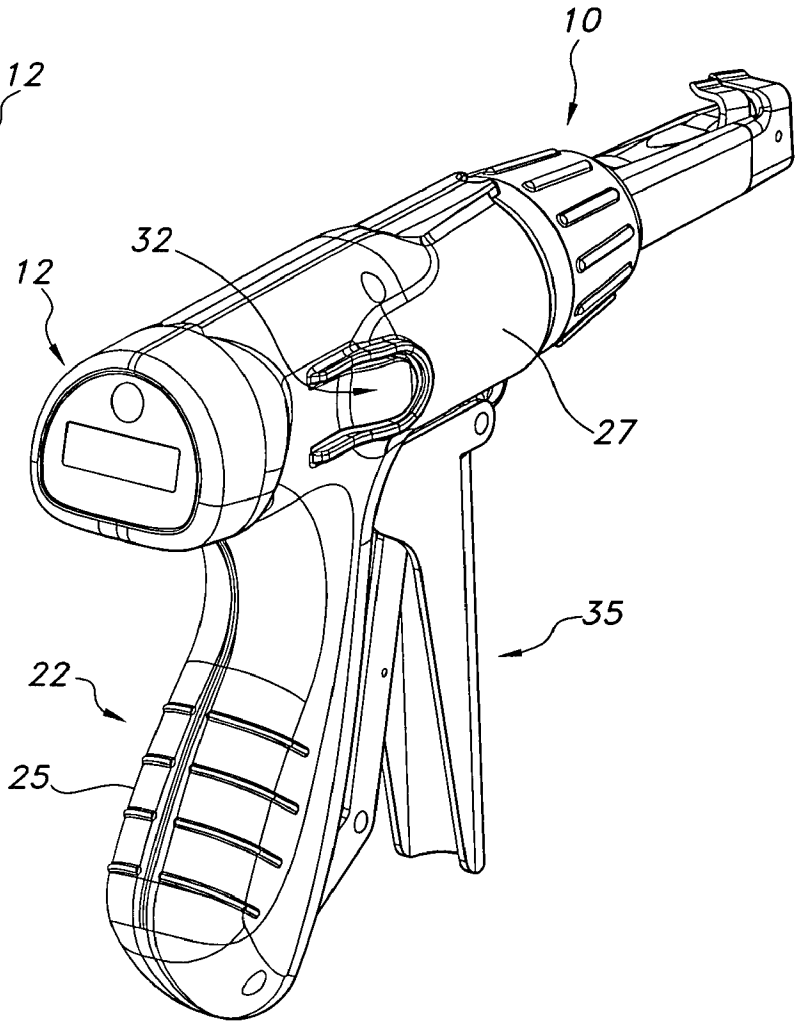
FIG. 2 is a rear perspective view of the tension and anti-recoil mechanism of FIG. 1, the mechanism being shown connected to the tool handle.
Figure 1:
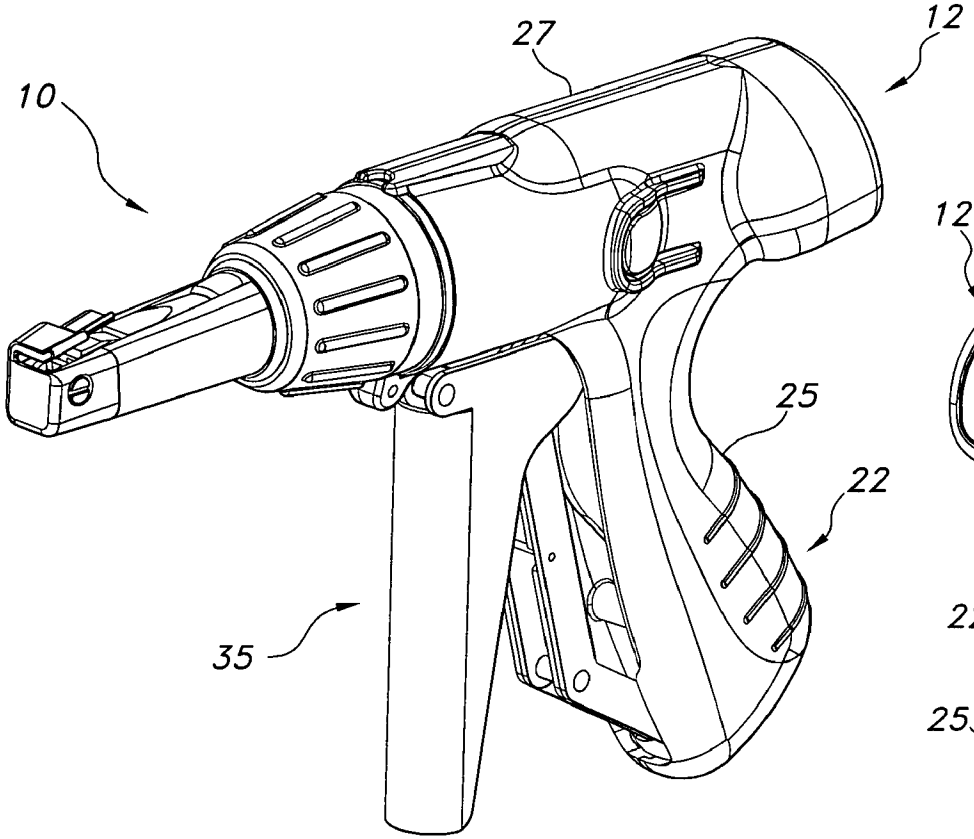
FIG. 1 is a front perspective view of the tension and anti-recoil mechanism of the present invention, the mechanism being shown connected to a tool handle of a cable tie tool.
Figures 3, 4, 5:
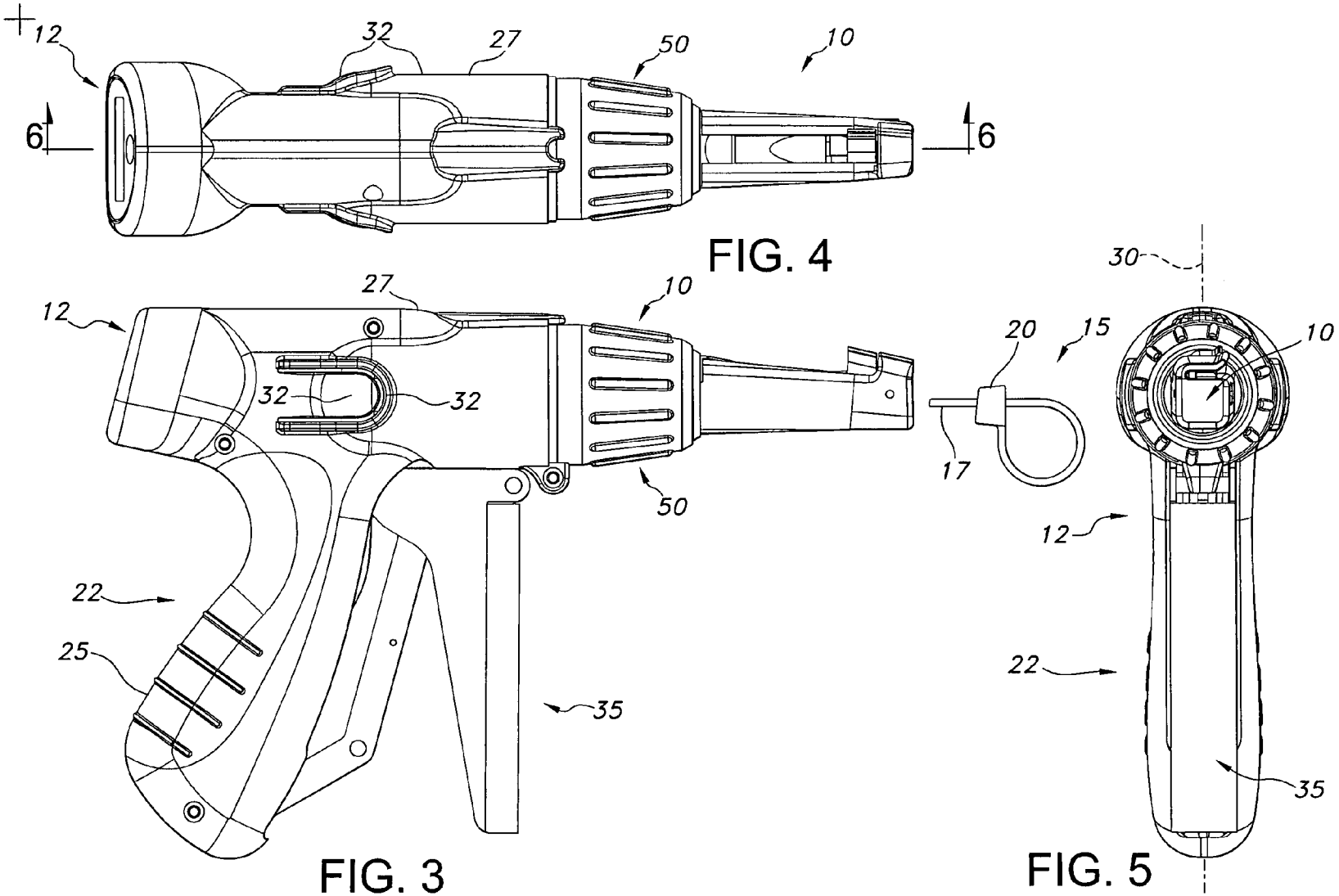
FIG. 3 is a side elevation view of the tension and anti-recoil mechanism and tool handle of FIG. 1.
FIG. 4 is a top plan view of the tension and anti-recoil mechanism and tool handle of FIG. 3.
FIG. 5 is a front elevation view of the tension and anti-recoil mechanism and tool handle of FIG. 3.
Figures 6, 7:
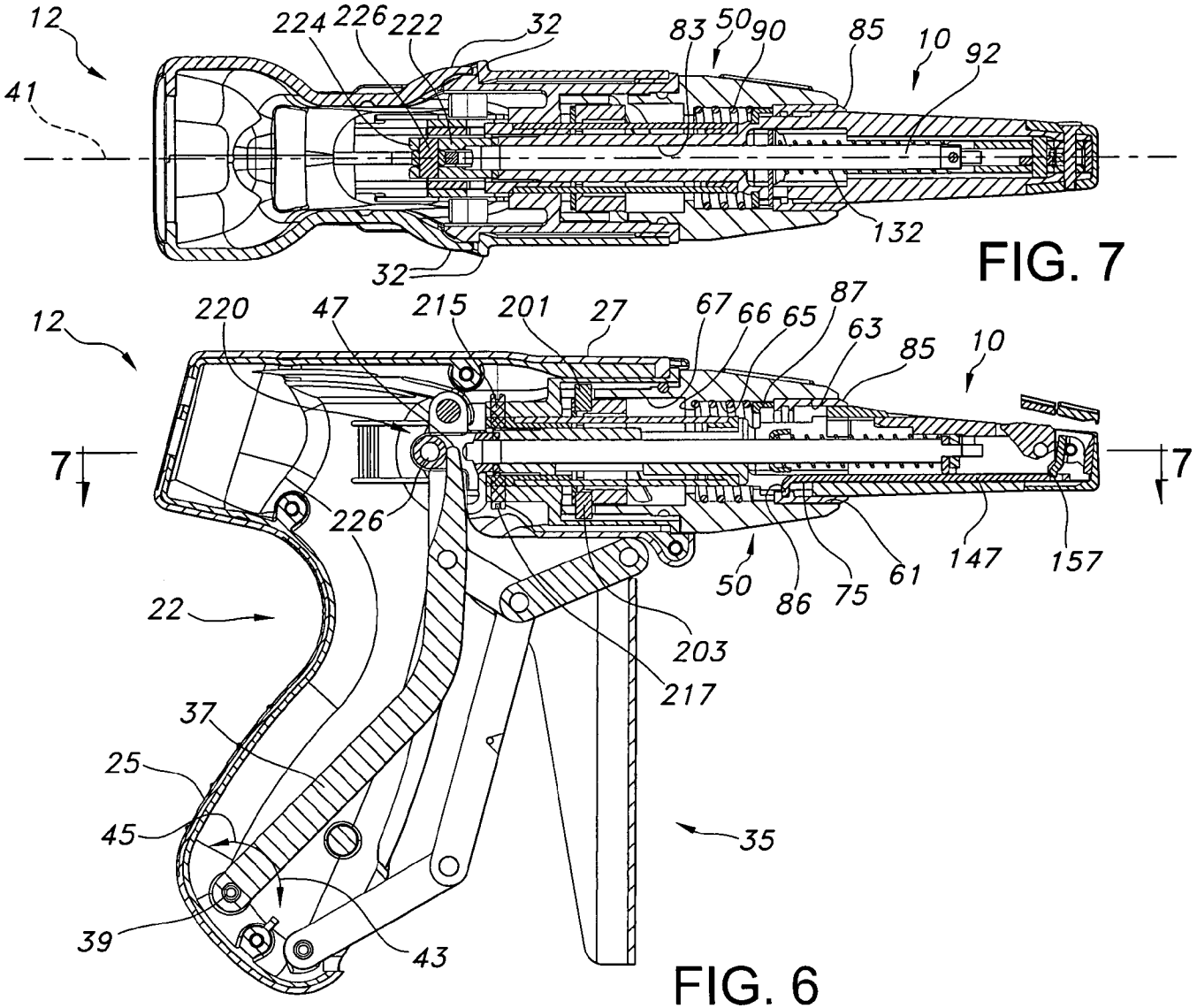
FIG. 6 is a cross-sectional view in the plane indicated by line 6-6 of FIG. 4 showing components located within the tension and anti-recoil mechanism and the linkage located within the tool handle.
FIG. 7 is a cross-sectional view in the plane indicated by line 7-7 of FIG. 6 showing components located within the tension and anti-recoil mechanism and tool handle.

Referring to the drawings and more particularly to FIGS. 1 to 5, a tension and anti-recoil mechanism 10 is shown in a cable tie tool 12 for securing a cable tie 15, having a strap 17 and head 20, to a bundle of articles, such as wires or cables. The tension and anti-recoil mechanism 10 is used with a tool handle 22 which together constitute the cable tie tool 12. The tension and anti-recoil mechanism 10 shown in FIGS. 6 and 7 is a modular assembly which may be removed from the tool handle 22 as a unit and may be referred to as a tool head. An example of the tension and anti-recoil mechanism 10 being such a modular assembly is disclosed in the U.S. patent application Ser. No. 11/055,029 filed in the USPTO on even date herewith and entitled "Cable Tie Tool Having Modular Tool Head", having as the inventor Joey D. Magno, Jr., Johan Tapper, Anders Fahlen, Joakim Norin, Goran Paulsson and Sven Wadling. It will be understood, however, that the tension and anti-recoil mechanism 10 may be included in alternative embodiments of the cable tie tool 15 in which the mechanism 10 is not readily removable from the tool handle 22.

The tool handle 22 has a pistol-shape, including a grip 25 which depends from a barrel 27, and a longitudinal central plane 30. The tool handle 22 includes a pair of latch mechanisms 32 each of which is integral with the barrel 27. Examples of the latch mechanisms 32 are disclosed in the U.S. patent application Ser. No. 11/055,929 filed in the USPTO on even date herewith and entitled "Cable Tie Tool Having Modular Tool Head", having as the inventor Joey D. Magno, Jr., Johan Tapper, Anders Fahlen, Joakim Norin, Goran Paulsson and Sven Wadling.

The tool handle 22 has a trigger mechanism 35 pivotally supported therein. The trigger mechanism 35 includes a rod link 37 the lower end of which is pivotally supported in the grip 25 by a transverse pin 39 generally adjacent to the lower end thereof, as shown in FIG. 6. The rod link 37 has a longitudinal axis 41 which is generally contained in the central plane 30, as shown in FIGS. 6 and 7. The pivotal connection provided by the pin 39 enables pivoting of the rod link 37 in the directions 43, 45 toward open and closed positions, respectively. The upper portion of the rod link 37 extends into the barrel 27. The upper end of the rod link 37 has a detent 47 for coupling to the tension and anti-recoil mechanism 10. An example of the trigger mechanism 35 is disclosed in the U.S. patent application Ser. No. 11/055,929 filed on even date herewith and entitled "Cable Tie Tool Having Modular Tool Head", having as the inventor Joey D. Magno, Jr., Johan Tapper, Anders Fahlen, Joakim Norin, Goran Paulsson and Sven Wadling.

The tension and anti-recoil mechanism 10 includes a regulator gr tubular member supported in the front of the barrel 27 in coaxial relation therewith. When the regulator grip 50 is fully inserted into the barrel 27, the regulator grip may be rotated about its longitudinal axis relative to the barrel. The outer surface of the regulator grip 50 includes a tapered front portion 52 the outer diameter of which decreases in the forward direction, and an annular rear portion 54. The rear portion 54 has an annular recess 55 in the outer surface thereof adjacent to the front portion 52. To the rear of the annular recess 55 in the rear portion 54 are a pair of helical slots 56, 58.

The regulator grip 50 has an longitudinal passage 61 in coaxial relation therewith. The longitudinal passage 61 has front, intermediate and rear portions 63, 65, 67 each of which has a circular cross-section. The cross-sectional dimension of each respective portion 63, 65, 67 is constant in the longitudinal direction. The cross-sectional dimension of the intermediate portion 65 is less than the cross-sectional dimensions of the front and rear portions 63, 67. The intermediate and rear portions 65, 67 are separated longitudinally by an inwardly extending collar portion 66.

Figure 9:
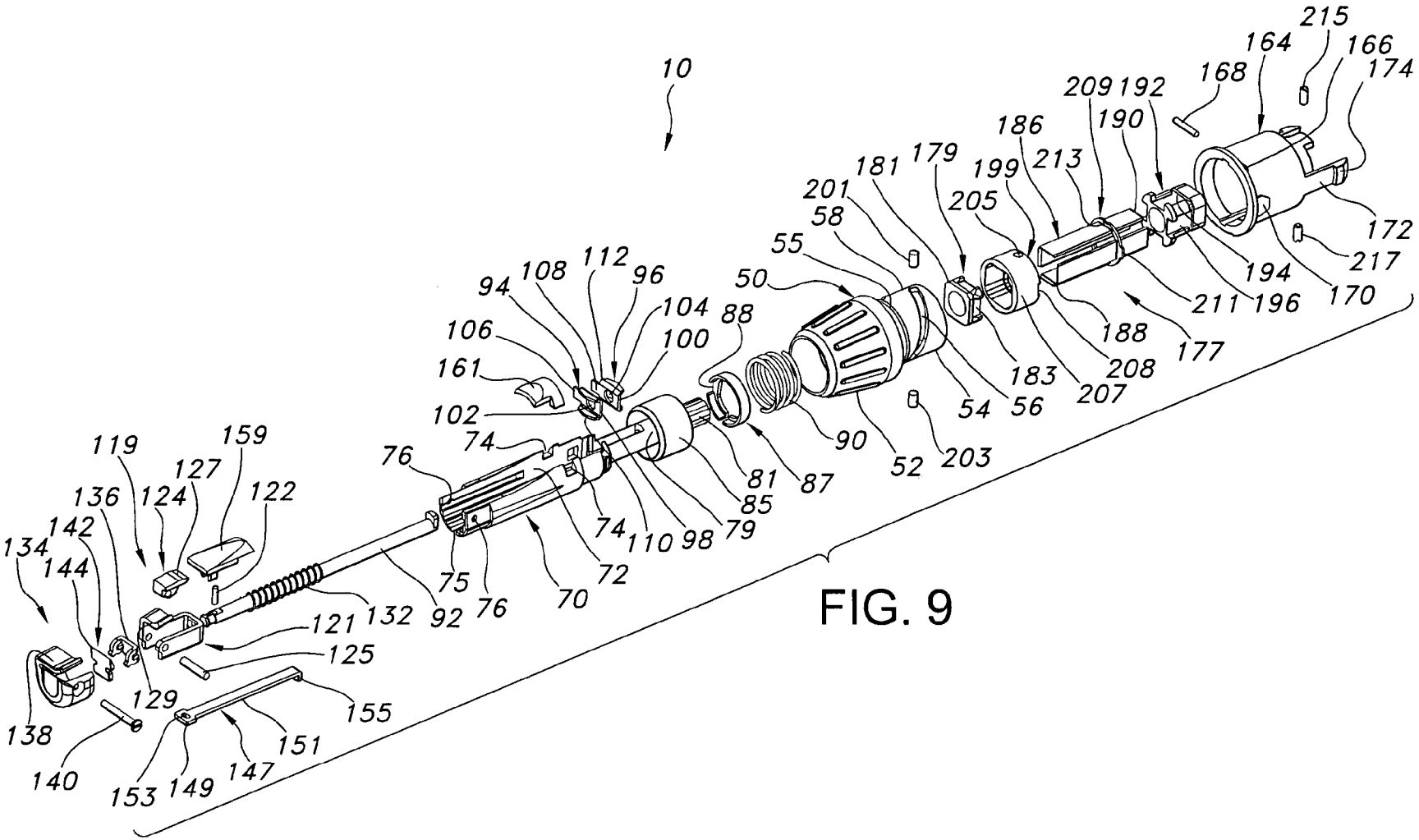
FIG. 9 is an exploded view of the tension and anti-recoil mechanism of FIG. 1.

The tension and anti-recoil mechanism 10 includes a cutter actuator 70 shown in FIG. 9. The cutter actuator 70 is an elongate, one-piece structure. The cutter actuator 70 is supported within the passage 61 of the regulator grip 50 in coaxial relation therewith, as shown in FIG. 6. The cutter actuator 70 is rotatable about the longitudinal axis thereof relative to the regulator grip 50. Consequently, the angular position of the cutter actuator 70 relative to the regulator grip 50 may be varied.

The cutter actuator 70 has a forward slot 72 with a generally U-shaped cross-section. A key window 74 extends through one of the sides of the forward slot 72 to the outer surface of the cutter actuator 70 generally adjacent to the back of the forward slot. The key window 74 is generally rectangular. The floor of the forward slot 72 has a longitudinal floor slot 75. Transverse coaxial cutter passages 76 extend through respective sides of the forward slot 72 generally adjacent to the front thereof.

The portion of the cutter actuator 70 which is to the rear of the forward slot 72 constitutes a rear portion 79 which is cylindrical. The rear end of the rear portion 79 has longitudinal splines 81 and longitudinal recesses therebetween. In a preferred embodiment, the rear portion 79 has eight splines and consequently eight longitudinal recesses between the splines. A longitudinal passage 83, having a circular cross-section, extends continuously through the entire length of the rear portion 79.

The tension and anti-recoil mechanism 10 includes a front ring 85 in coaxial relation with the regulator grip 50. The front ring 85 is located within the front portion 63 of the regulator grip 50, as shown in FIG. 6. The front ring 85 is connected to the regulator grip 50 by a press-fit such that rotation of the regulator grip produces corresponding rotation of the front ring. The front ring 85 has an annular recess 86 on the inner surface thereof.

The tension and anti-recoil mechanism 10 includes an intermediate ring 87 in coaxial relation with the rear portion 79 of the cutter actuator 70. The intermediate ring 87 is located within the intermediate portion 65 of the regulator grip 50 to the rear of the front ring 85, as shown in FIG. 6. The intermediate ring 87 is connected to the cutter actuator 70 by a snap-fit such that rotation of the cutter actuator produces corresponding rotation of the intermediate ring. The intermediate ring 87 has an arcuate gap 88 extending rearward from the front edge thereof, as shown in FIG. 9.

The tension and anti-recoil mechanism 10 includes a cutter actuator spring 90 constituted by a helical spring located within the intermediate portion 65 of the regulator grip 50, as shown in FIG. 6. The cutter actuator spring 90 is in coaxial relation with the rear portion 79 of the cutter actuator 70. The cutter actuator spring 90 is compressed between the intermediate ring 87 and collar portion 66. Accordingly, the cutter actuator spring 90 resists rearward displacement of the cutter actuator 70 relative to the regulator grip 50.

The tension and anti-recoil mechanism 10 includes a pull rod 92 which extends through the passage 83 and forward slot 72 in the cutter actuator 70, as shown in FIG. 6. Such extension of the pull rod 92 is provided by sufficiently large cross-section areas of the passage 83 and forward slot 72 which provide a sufficient radial clearance between the pull rod, passage and forward slot to allow longitudinal translation of the pull rod relative to the cutter actuator 70.

The tension and anti-recoil mechanism 10 includes a pair of lock washers 94, 96. Each of the lock washers 94, 96 is a one-piece structure having respective planar central portions 98, 100 with apertures 102, 104. Each of the lock washers 94, 96 includes a respective key 106, 108 extending laterally from opposite side edges of the respective central portions 98, 100. Each of the lock washers 94, 96 has lips 110, 112 extending from upper and lower edges of the central portions 98, 100 in generally perpendicular relation thereto.

The lock washers 94, 96 are positioned in the forward slot 72 of the cutter actuator 70 generally adjacent to the rear thereof such that the central portions 98, 100 adjoin one another and establish the lock washer 94 as the front lock washer and the lock washer 96 as the rear lock washer. Such adjoining relation is provided by the orientations of the front lock washer 94 such that the lips 110 thereof face forwardly and the rear lock washer 96 such that the lips 112 thereof face rearwardly. The orientations of the front and rear lock washers 94, 96 provide for the extension of the keys 106, 108 through the key window 74. The keys 106, 108 are each sized to extend beyond the outer surface of the cutter actuator 82 transversely thereof.

The apertures 102, 104 of the front and rear lock washers 94, 96 are sufficiently large to allow the pull rod 92 to extend therethrough and to allow longitudinal translation of the pull rod relative to the lock washers when the central portions 98, 100 are perpendicular to the longitudinal axis of the cutter actuator 70. This perpendicular orientation of the central portions 98, 100 define the released positions 114, 116 of the front and rear lock washers 94, 96.

The keys 106, 108 have sufficient radial dimensions such that, when the cutter actuator 70 is translated in the forward direction into the passage 61 of the regulator grip 50, the rear edge of the key window 74 engages the key 108 of the rear lock washer 96 for translation of the central portion 100 thereof into engagement with the central portion 98 of the front lock washer 94. Continuing such forward insertion of the cutter actuator 70 causes the outer portion of the key 106 of the front lock washer 94 to be forced against the rear end of the front ring 85 resulting in the front and rear lock washers 94, 96 being pivoted about the key window 74 to the released positions 114, 116.

The lock washers 94, 96 are positioned longitudinally to the front of the intermediate ring 87, as shown in FIG. 7. The keys 106, 108 of the lock washers 94, 96 are located within the gap 88 of the intermediate ring 87.

The tension and anti-recoil mechanism 10 has a pawl assembly 119 including a pawl cage 121. The pawl cage 121 has a rear surface with an opening through which the forward end of the pull rod 92 extends, as shown in FIGS. 7 and 9. A transverse pin 122 extends through the end of the pull rod 92 which is forward of the rear surface of the pawl cage 121. This results in rearward translation of the pull rod 92 producing corresponding rearward translation of the pawl cage 121. The portion of the pull rod 92 to the rear of the pawl cage 121 has an outer diameter which is larger than the opening in the pawl cage 121 through which the pull rod extends, as shown in FIG. 6. This results in forward translation of the pull rod 92 producing corresponding forward displacement of the pawl cage 121.

The pawl assembly 119 includes a pawl grip 124 which is pivotally supported within the pawl cage 121 by a transverse pin 125 which is transversely and longitudinally fixed to opposing sides of the pawl cage. The pawl grip 124 pivots between an open position in which the teeth 127 thereof are pivoted downward and rearward away from the engagement surface 129 of the pawl cage 121 and closed position in which the teeth 127 are pivoted upward and forward toward the engagement surface to clamp the strap 17 therebetween to grip and thereby longitudinally fix the strap to the pawl assembly 119. The pawl assembly 119 includes a pawl spring which is compressed between the pawl grip 124 and pawl cage 121 to urge the pawl grip to pivot to the closed position. An example of a mechanism for causing the pawl grip 124 to pivot to the open position and subsequently to the closed position is disclosed in U.S. Pat. No. 5,915,425 at column 8, lines 3 to 19 and FIGS. 7, 7*a* and 7*b*. The teeth 127 of the pawl grip 124 are shaped such that forward displacement of the pawl assembly 119 relative to the strap 17 results in the pawl grip pivoting forward and downward against the urging of the pawl spring thereby releasing the strap from the teeth of the pawl grip 124. Consequently, the pawl assembly 119 may translate longitudinally forward relative to the strap 17 for subsequent gripping thereof by the teeth 127 of the pawl grip 124 for further tensioning of the strap.

The tension and anti-recoil mechanism 10 includes a pull rod spring 132 comprising a helical spring located in the forward slot 72 of the cutter actuator 70 such that the pull rod 92 extends through the pull rod spring. The pull rod spring 132 is compressed between the central portion 98 of the front lock washer 94 and pawl cage 121 to resist rearward displacement thereof relative to the front lock washer. Additionally, the pull rod spring 132 urges the front lock washer 94 rearward causing the central portion 98 thereof to pivot rearward about the key 106 when the lock washer is displaced rearward by the cutter actuator 70. Such pivoting of the front lock washer 94 causes corresponding pivoting of the rear lock washer 96 resulting in the central portion 100 thereof pivoting rearward about the key 108.

The tension and anti-recoil mechanism 10 has a cutter mechanism 134 including a cutter bracket 136 and a nose bracket 138. The cutter bracket 136 is located between the respective sides of the forward slot 72 generally adjacent to the forward end thereof such that the cutter mechanism 134 is forward of the pawl assembly 119. The nose bracket 138 is located outward of the respective sides of the forward slot 72 generally adjacent to the forward end thereof such that the nose bracket has generally the same longitudinal position as the cutter bracket 136. The cutter and nose brackets 136, 138 are pivotally supported by a transverse pin 140 which extends through the cutter passages 76 in the respective sides of the forward slot 72 to longitudinally fix the cutter and nose brackets 136, 138 to the forward end of the cutter actuator 70.

Figure 11:
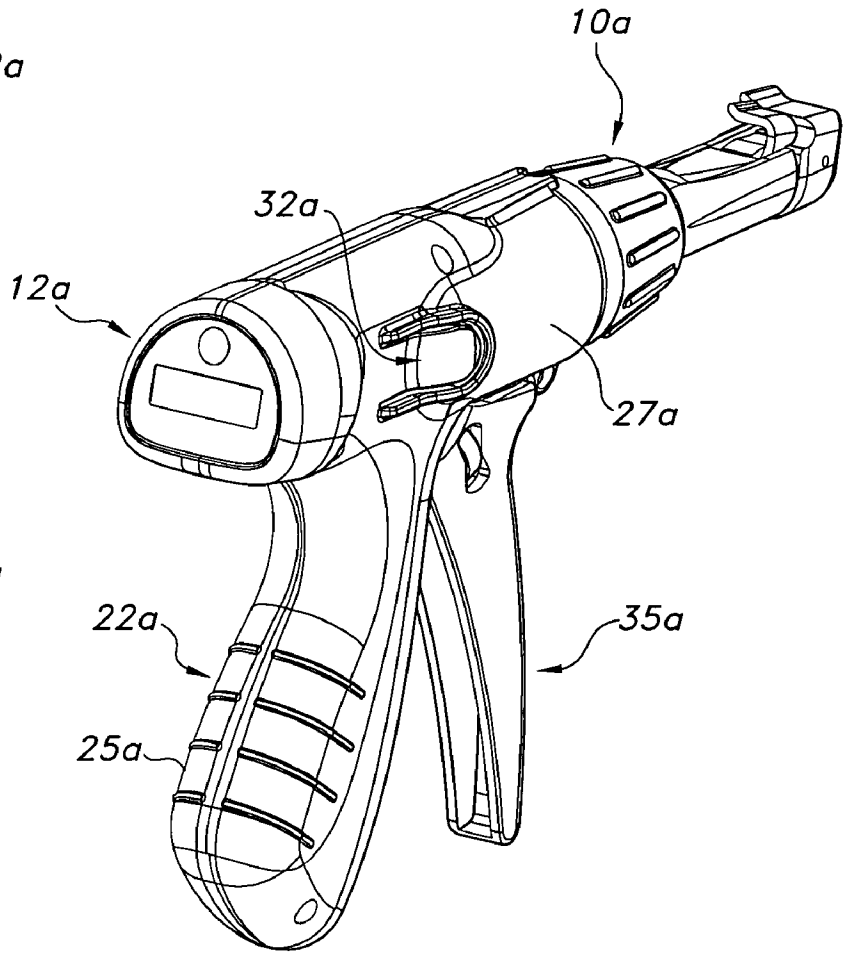
FIG. 11 is a rear perspective view of the tension and anti-recoil mechanism and tool handle of FIG. 10.
Figure 10:
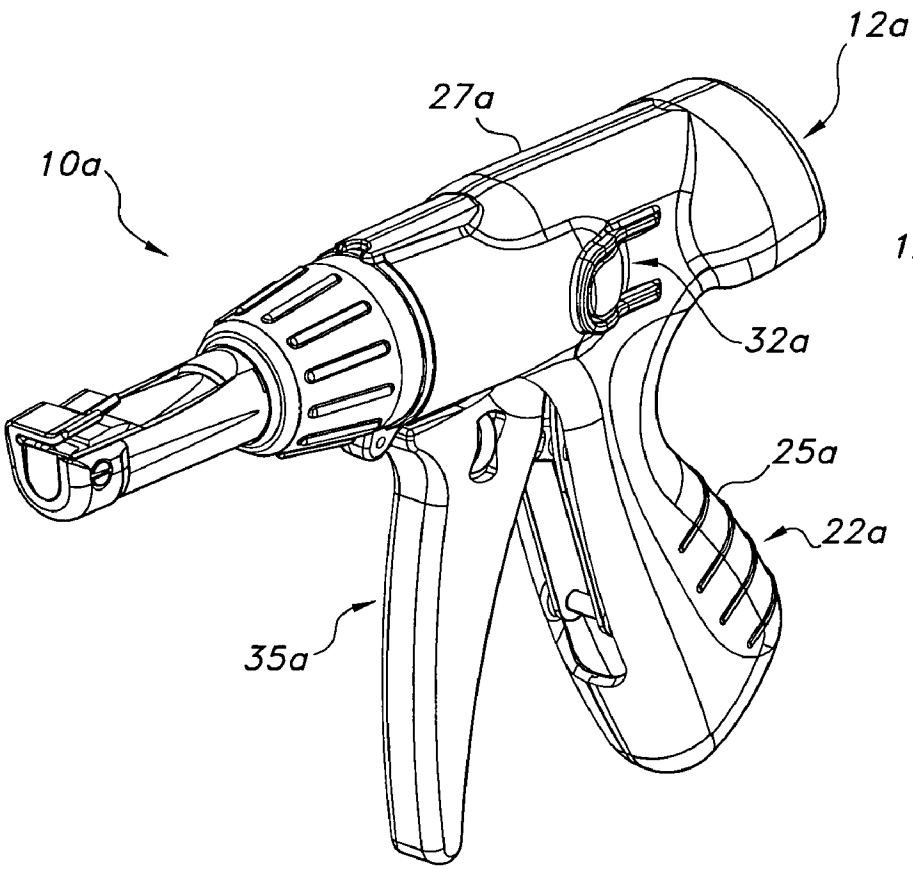
FIG. 10 is a front perspective view of the tension and anti-recoil mechanism of the present invention, the mechanism being shown connected to an alternative second embodiment of tool handle of a cable tie tool.
Figures 12, 13, 14, 15:
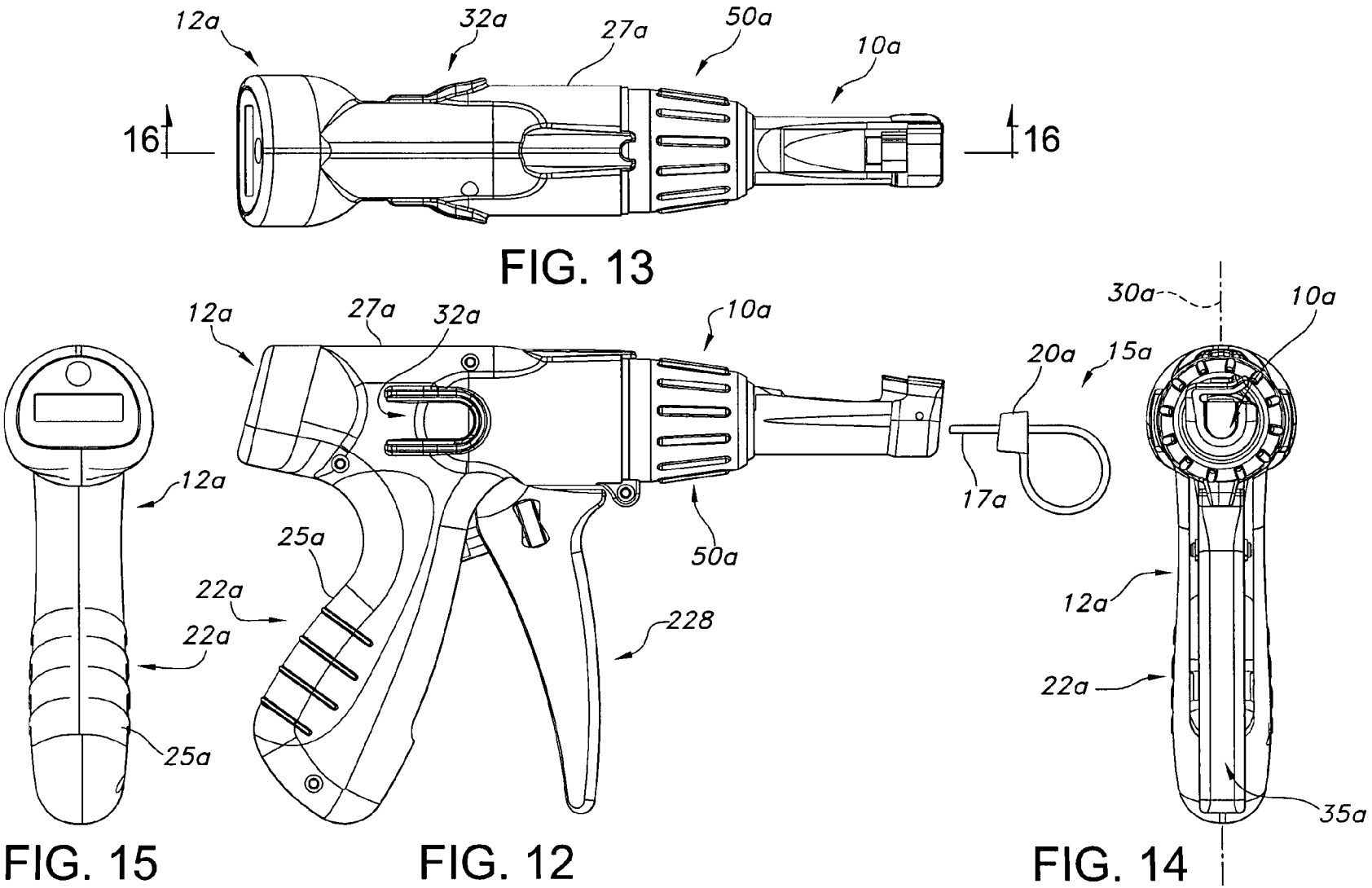
FIG. 12 is a side elevation view of the tension and anti-recoil mechanism and tool handle of FIG. 10.
FIG. 13 is a top plan view of the tension and anti-recoil mechanism and tool handle of FIG. 12.
FIG. 14 is a front elevation view of the tension and anti-recoil mechanism and tool handle of FIG. 12.
FIG. 15 is a rear elevation view of the tension and anti-recoil mechanism and tool handle of FIG. 12.
Figure 17:
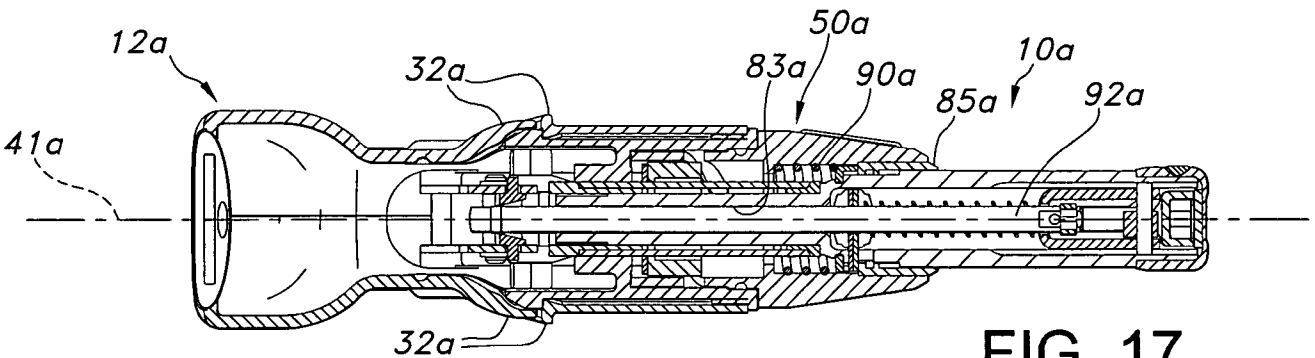
FIG. 17 is a cross-sectional view in the plane indicated by line 17-17 of FIG. 16 showing components located within the tension and anti-recoil mechanism and tool handle.
Figure 16:
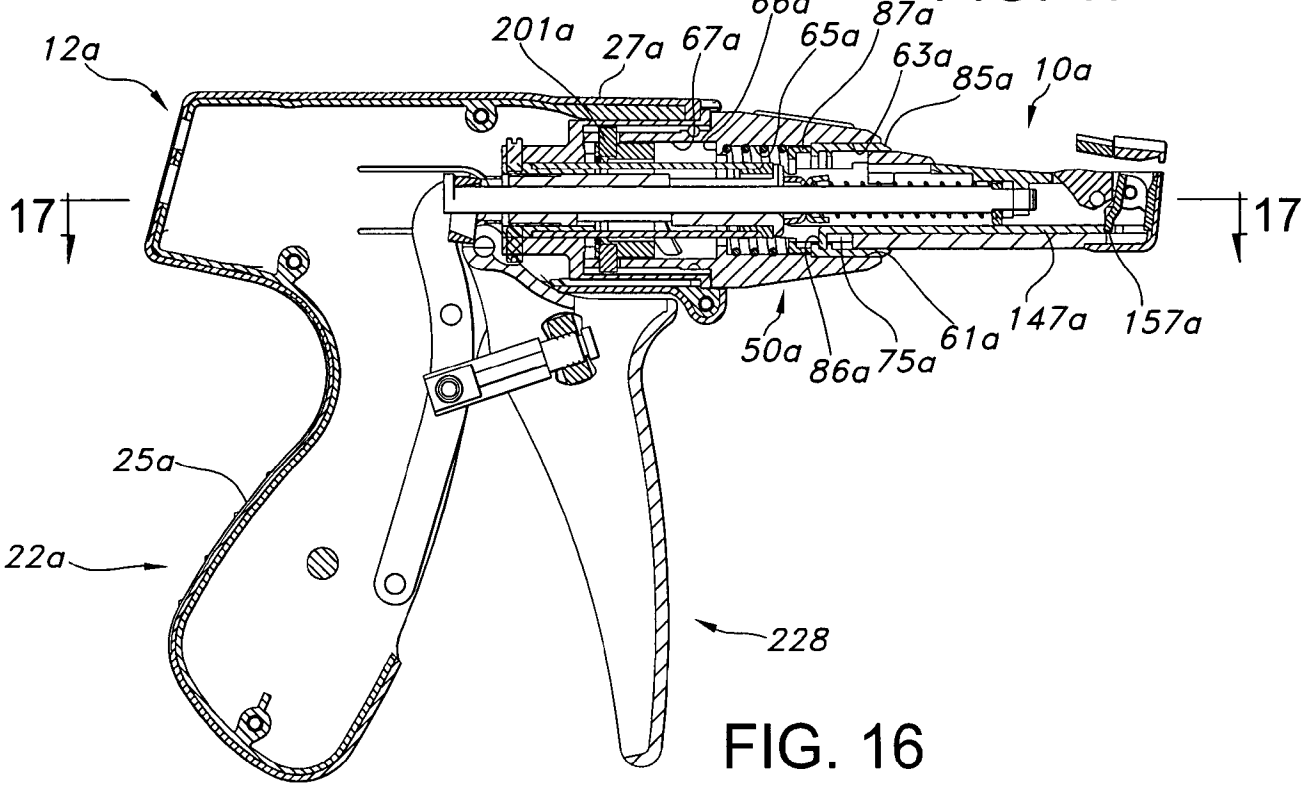
FIG. 16 is a cross-sectional view in the plane indicated by line 16-16 of FIG. 13 showing components located within the tension and anti-recoil mechanism and the linkage located within the tool handle.
Figure 18:
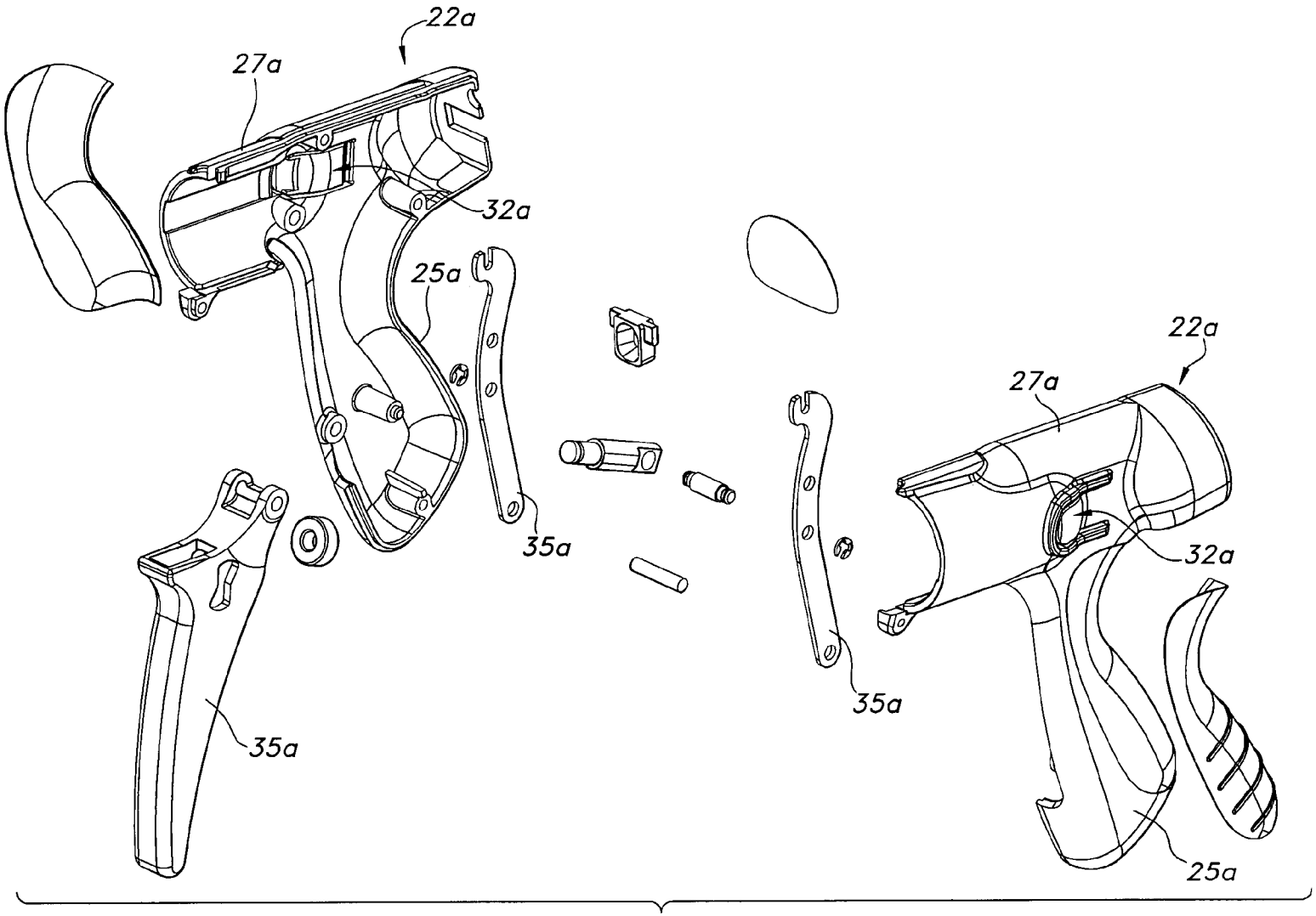
FIG. 18 is an exploded view of the tool handle of FIG. 10 showing the linkage located within the tool handle.
Figure 19:
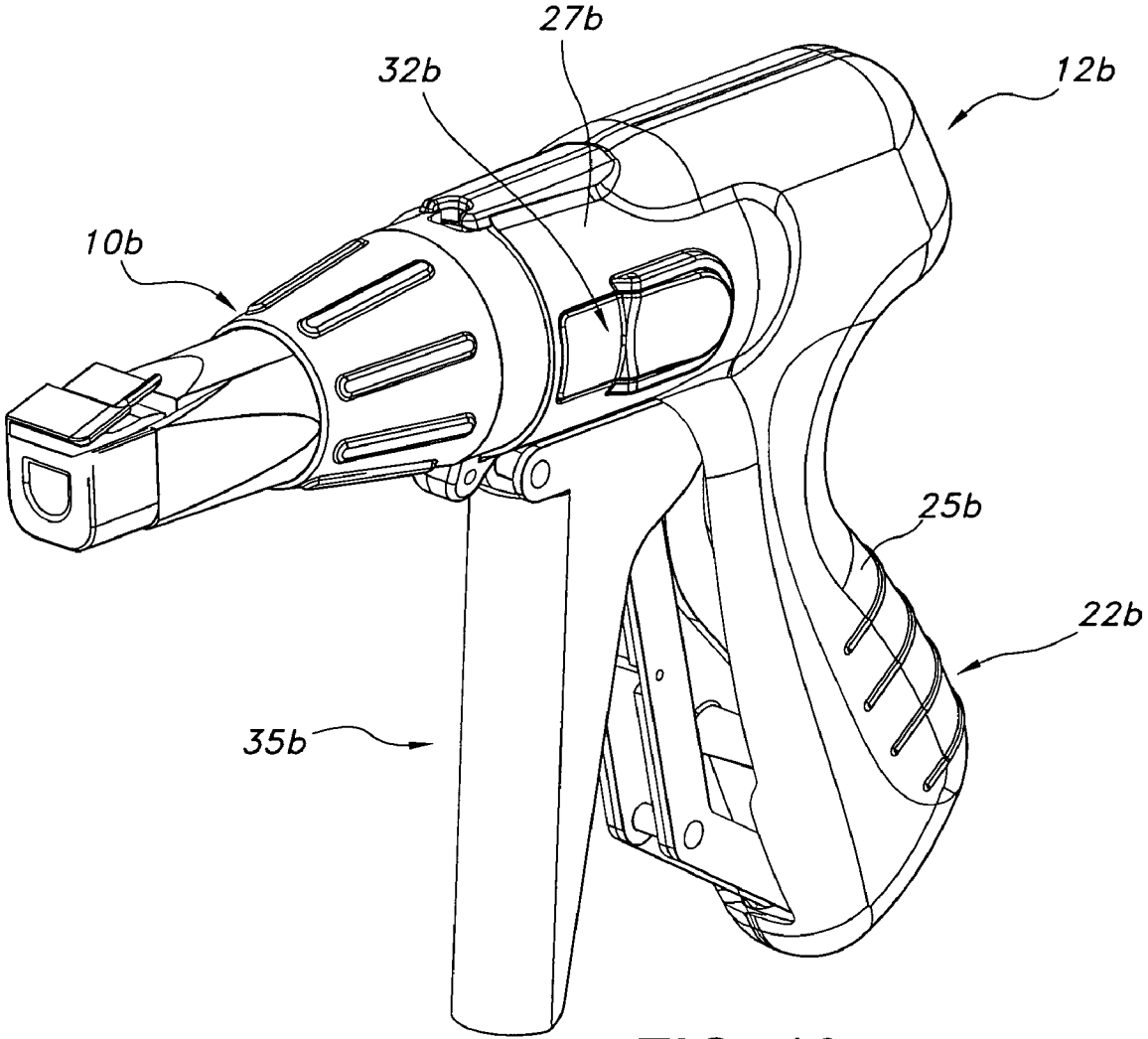
FIG. 19 is a front perspective view of an alternative second embodiment of the tension and anti-recoil mechanism of the present invention, the mechanism being shown connected to a tool handle of a cable tie tool.
Figure 21:
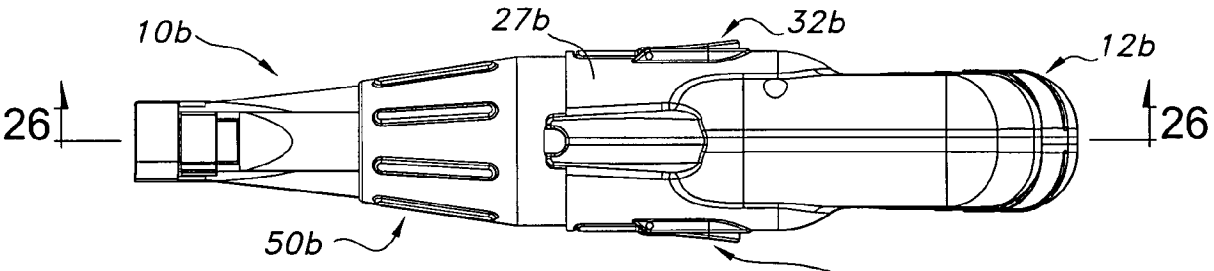
FIG. 21 is a top plan view of the tension and anti-recoil mechanism and tool handle of FIG. 20.
Figure 20:
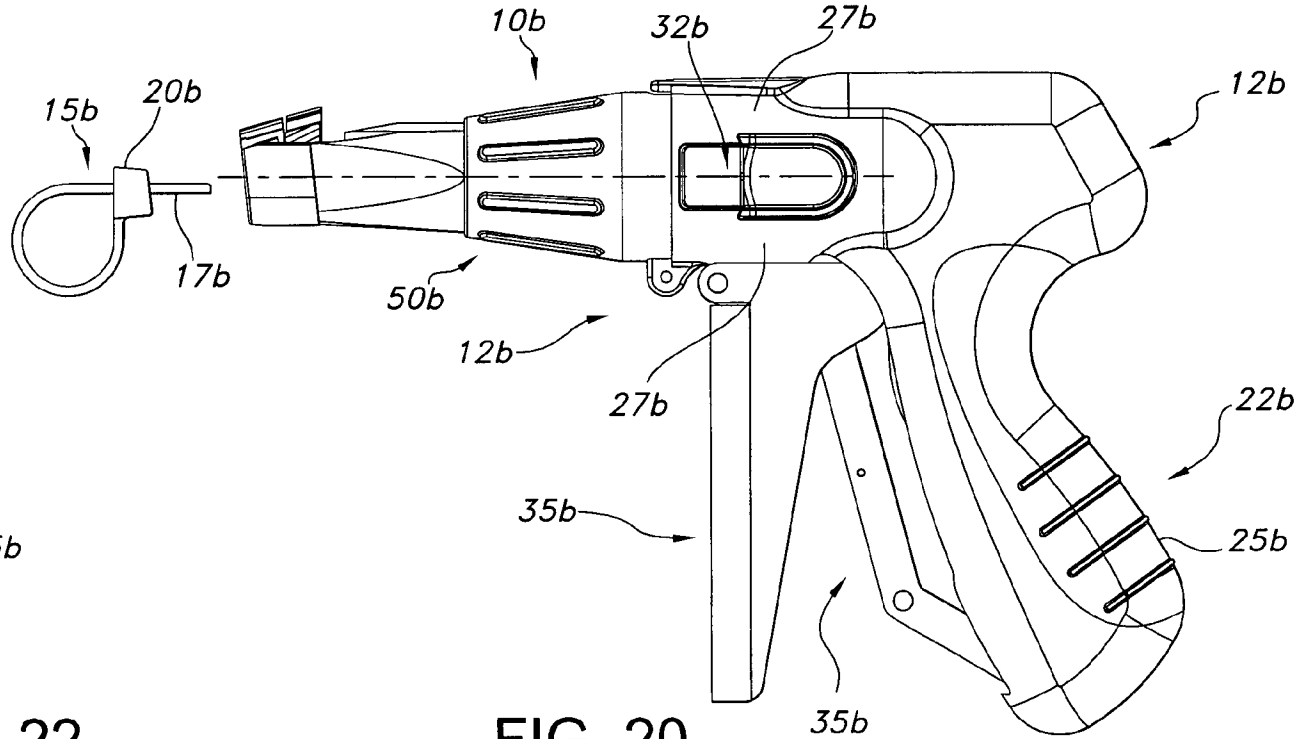
FIG. 20 is a side elevation view of the tension and anti-recoil mechanism and tool handle of FIG. 19.
Figure 22:
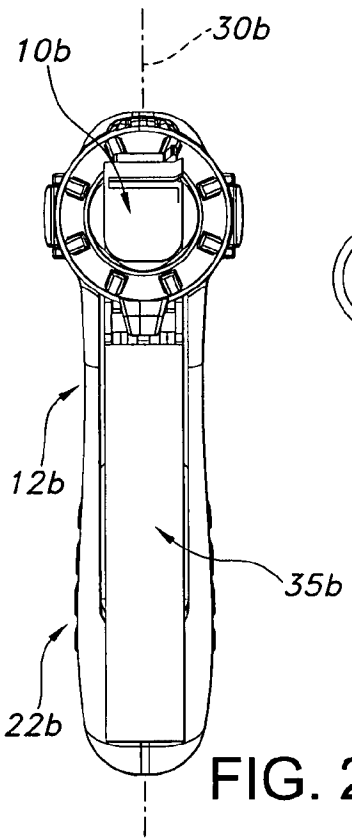
FIG. 22 is a front elevation view of the tension and anti-recoil mechanism and tool handle of FIG. 20.
Figure 24:
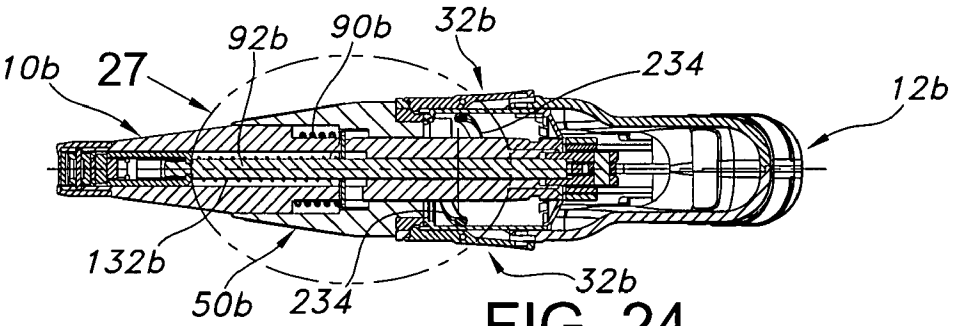
FIG. 24 is a cross-sectional view in the plane indicated by line 24-24 of FIG. 23 showing components within the tension and anti-recoil mechanism and tool handle.
Figure 23:
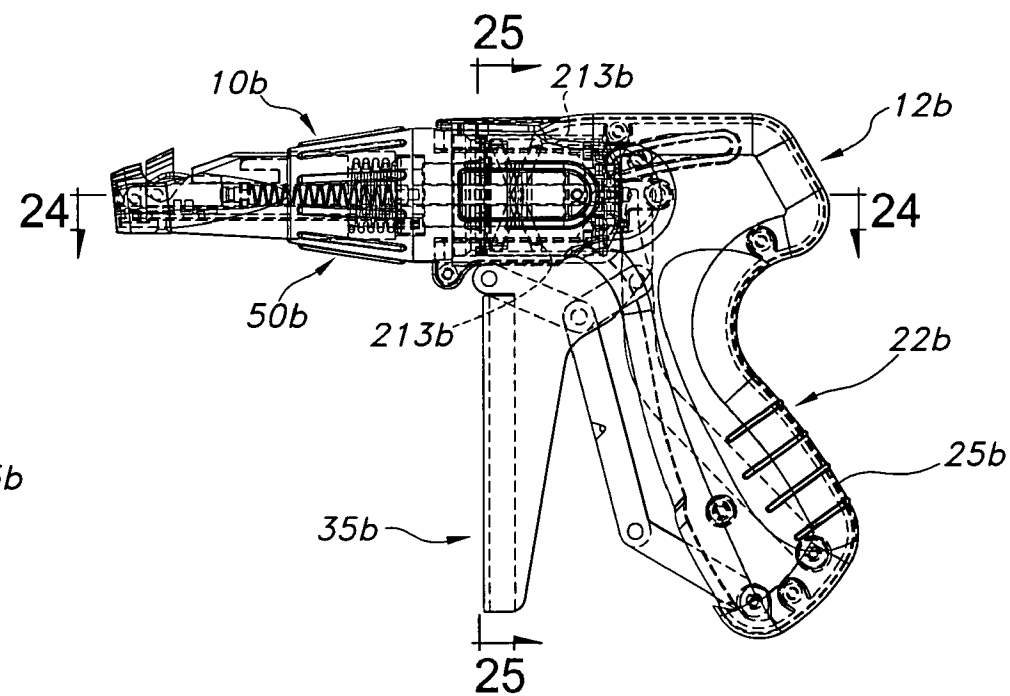
FIG. 23 is a side elevation view of the tension and anti-recoil mechanism and tool handle of FIG. 19, the tension and anti-recoil mechanism and tool handle being shown as transparent to show components therein.
Figure 25:
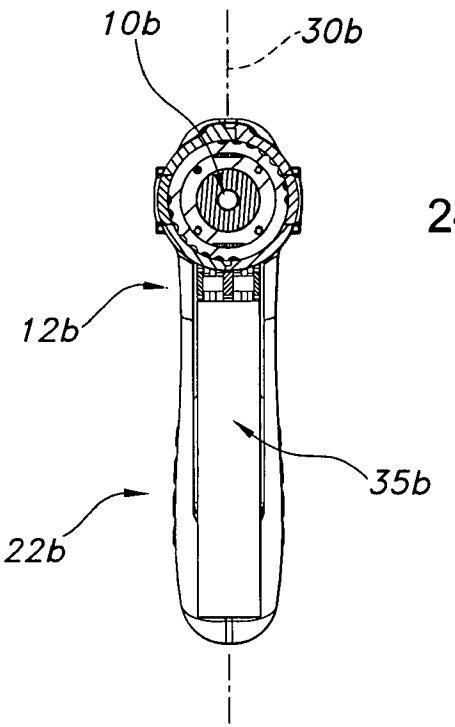
FIG. 25 is a front elevation view in partial cross-section in the plane indicated by line 25-25 of FIG. 23 showing components within the tension and anti-recoil mechanism and tool handle.
Figure 26:
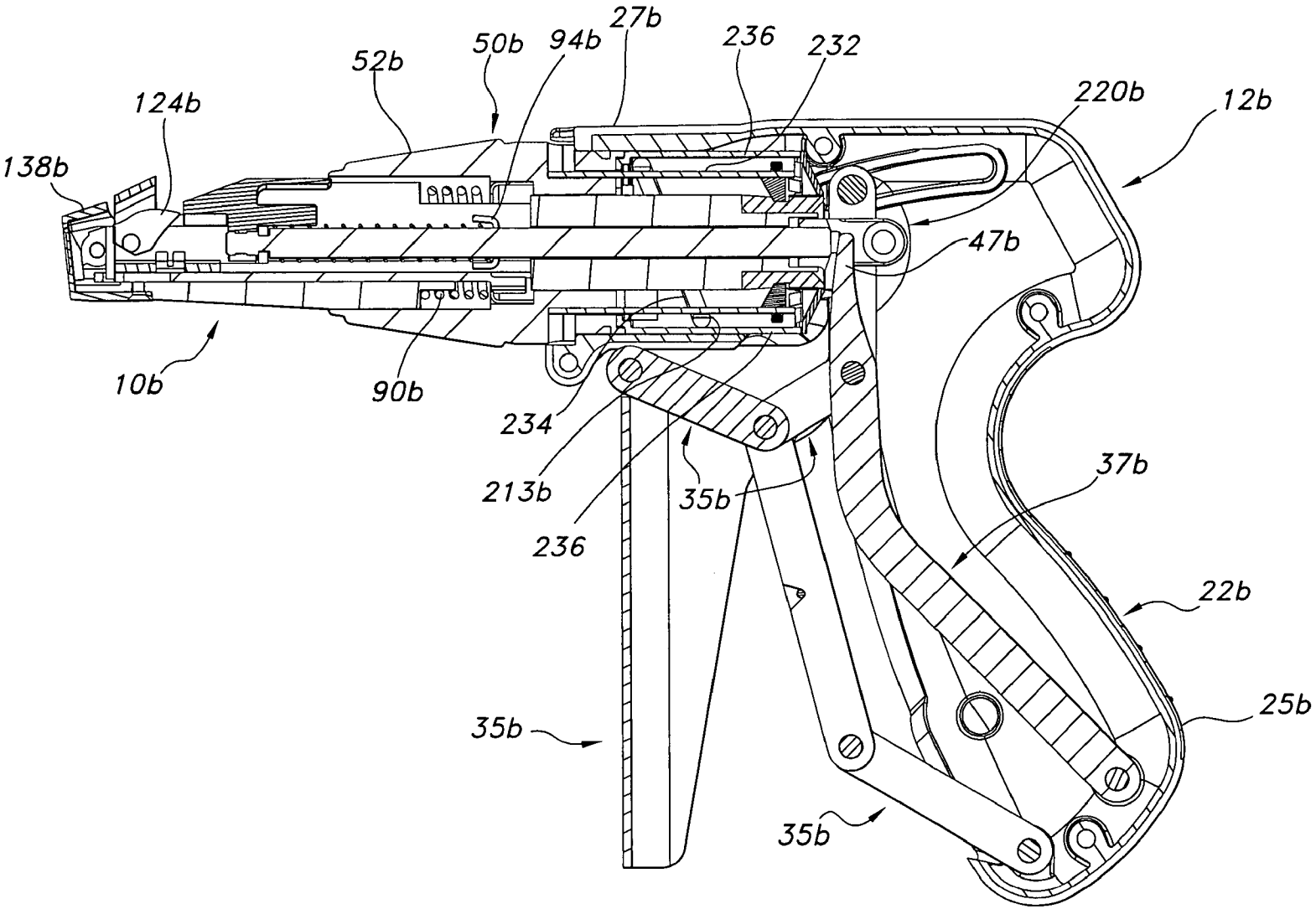
FIG. 26 is a cross-sectional view in the plane indicated by line 26-26 of FIG. 21 showing components within the tension and anti-recoil mechanism and tool handle.
Figure 27:
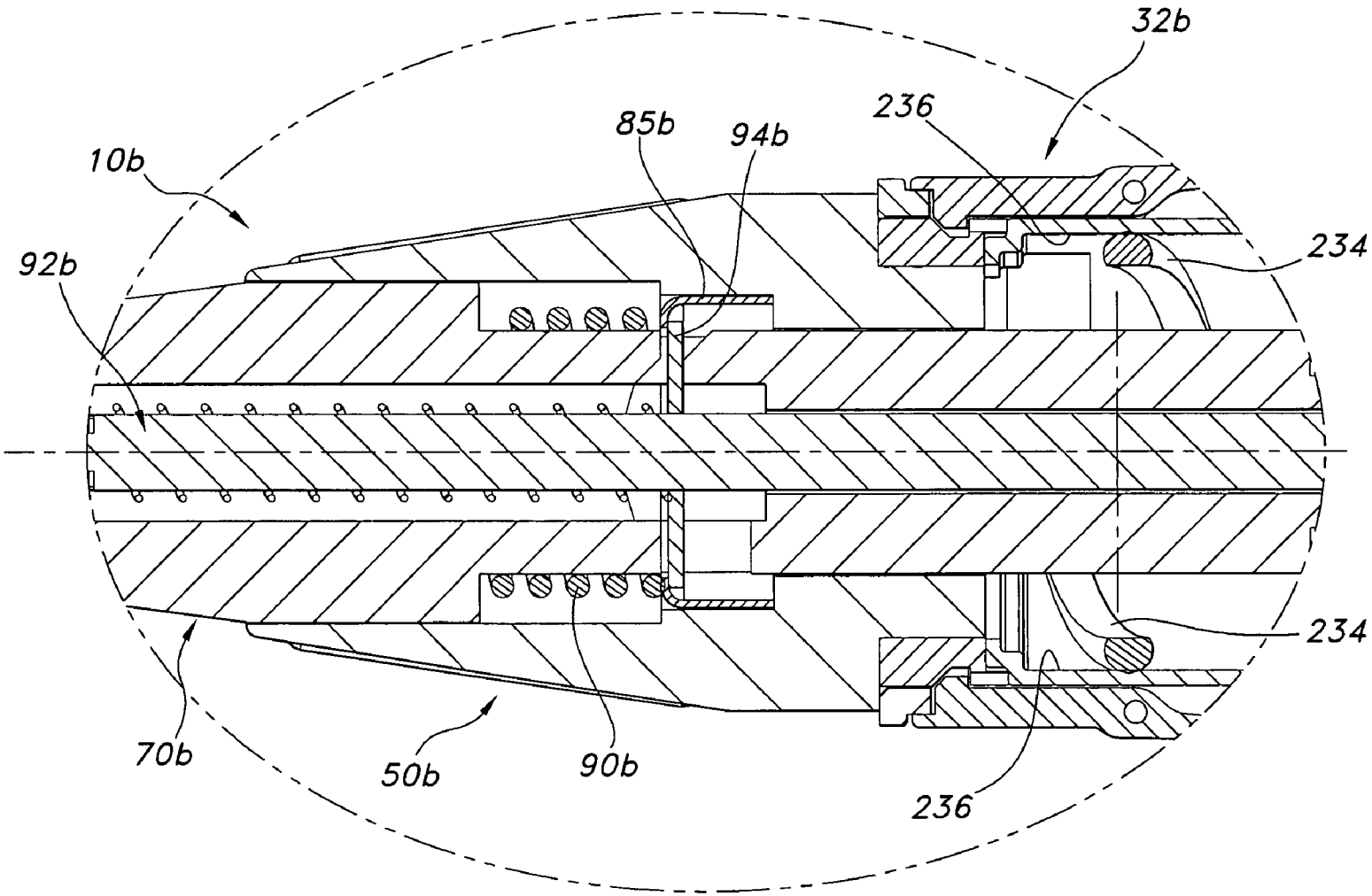
FIG. 27 is an enlarged view of the circled portion 27 of FIG. 24 showing the lock washer in abutment with the front ring allowing displacement of the pull rod relative to the cutter actuator.

The cutter mechanism 134 includes a blade 142 mounted on the cutter bracket 136 such that pivoting of the cutter bracket about the pin 140 causes generally vertical translation of the blade between a lower open position and an upper closed position. The upper edge of the blade 142 defines a cutting edge 144 such that translation of the blade to the closed position results in severing of the excess portion of the strap 17 of the cable tie 15. Translation of the blade 142 to the open position enables insertion of a strap 17 of a cable tie 15 into the cutter mechanism 134. Examples of the open and closed positions of the blade 142 are disclosed in U.S. Pat. No. 5,915,425 at column 8, lines 20 to 28 and FIGS. 10, 11 and 12.

The tension and anti-recoil mechanism 10 includes an elongate cutter arm 147 which extends through the forward slot 72 and is seated on the floor thereof in the longitudinal recess 87. The cutter arm 147 has forward and intermediate portions 149, 151, with the forward portion 149 being wider than the intermediate portion 151. The forward portion 149 of the cutter arm 147 has a slot 153.

The cutter arm 147 has a foot 155 extending rearward from the intermediate portion 151. The end of the foot 155 extends downward through the floor slot 75 of the forward slot 72 into the annular recess 86 in the front ring 85 to longitudinally fix the cutter arm 147 relative thereto, as shown in FIG. 6. The longitudinal dimension of the foot 155 is less than that of the floor slot 75 such that the extension of the foot therethrough does not prevent longitudinal translation of the cutter actuator 70 relative to the regulator grip 50.

The cutter mechanism 134 includes an elongate cutter link 157 which depends from the cutter bracket 136 of cutter mechanism 134 and extends into the slot 153 in the cutter arm 147 adjacent to the forward end thereof. This coupling of the cutter bracket 136 to the cutter arm 147 results in upward pivoting of the cutter bracket when the cutter actuator 70 is translated rearward relative to the cutter arm. Such upward pivoting of the cutter bracket 136 causes the upward translation of the blade 142 to the closed position thereof. An example of this relation between the movement of the blade 142 and relative translation of the cutter actuator 70 is disclosed in U.S. Pat. No. 5,915,425 at column 8, lines 20 to 28, and column 9, lines 41 to 51, and FIGS. 7, 7*a*, 11 and 12.

The tension and anti-recoil mechanism 10 includes a front cap 159 which is connected to the pull rod 92 by a snap fit. A rear cap 161 is connected to the cutter actuator 70 by a snap fit such that the forward end of the rear cap contacts the upper surface of the front cap 159, as shown in FIG. 6. This contact between the front and rear caps 159, 161 allows longitudinal translation of the front cap relative to the rear cap when the pull rod 92 is longitudinally translated relative to the cutter actuator 70. During such relative translation, the rear portion of the front cap 159 is beneath the rear cap 161.

The tension and anti-recoil mechanism 10 includes a rear housing ring 164 located to the rear of the regulator grip 50 in coaxial relation thereto, as shown in FIGS. 6, 7 and 9. The housing ring 164 has a transverse passage 166 adjacent to the front thereof in tangential relation to the outer surface of the ring. The housing ring 164 is longitudinally aligned with the regulator grip 50 such that the longitudinal positions of the transverse passage 166 and annular recess 55 coincide. A transverse pin 168 is inserted through the passage 166 and recess 55 to prevent longitudinal translation of the housing ring 164 relative to the regulator grip 50. Such insertion of the pin 168 through the recess 55 does not prevent rotation of the regulator grip 50 relative to the housing ring 164 because of the continuity of the recess 55.

The rear housing ring 164 has a pair of diametrically opposed lateral protrusions 170 on the outer surface thereof, as shown in FIG. 9. The lateral protrusions 170 have a tapered portion the vertical dimension of which decreases toward the rear. The lateral protrusions 170 fit into corresponding recesses in the inner surface of the barrel 27 when the housing ring 164 is inserted therein to prevent rotation of the housing ring relative to the barrel.

The rear housing ring 164 has a pair of diametrically opposed arms 172 each of which extends rearwardly from the rear edge of the ring. The arms 172 each have rear end portions the outer surfaces of which have hook formations 174 thereon.

The tension and anti-recoil mechanism 10 includes a front spring support 179 through which the rear portion 79 of the cutter actuator 70 extends, as shown in FIGS. 6, 7 and 9. The spring support 179 is longitudinally fixed to the cutter actuator 70. The connection between the spring support 179 and cutter actuator 70 allows rotation of the spring support relative to the cutter actuator. The spring support 179 has a front edge 181 which is chamfered. The outer surface of the spring support 179 to the rear of the front edge 181 has upper, lower and lateral portions 183 which are recessed and flat, and extend longitudinally.

The tension and anti-recoil mechanism 10 has a tension limiting mechanism 177 which includes four longitudinal blade springs 186 longitudinally positioned within the regulator grip 50 as shown in FIGS. 6 and 7. Each of blade springs 186 has a front and rear end 188, 190. Each of the front ends 188 is supported in a corresponding portion 183 of the spring support 179.

The tension limiting mechanism 177 includes a rear spring support 192 through which the rear portion 79 of the cutter actuator 70 extends, as shown in FIGS. 6, 7 and 9. The spring support 192 is longitudinally and rotatably secured to the rear housing ring 164. The spring support 192 has a rear portion which has a larger cross section than that of the front portion to establish a rear edge 194 which faces to the front. The outer surface of the spring support 192 to the front of the rear edge 194 has upper, lower and lateral portions 196 which are recessed and flat, and extend longitudinally.

Each of the rear ends 190 of the blade springs 186 is supported in a corresponding portion 196 of the spring support 192 such that the rear ends 190 abut the rear edge 194. This abutment prevents rearward displacement of the blade springs 186 relative to the spring support 192. As a result, the blade springs 186 are prevented from rearward displacement by rearward translation of the front spring support 179 relative to the blade springs. Such rearward translation of the front spring support 179, which may result from rearward translation of the cutter actuator 70, results in the front edge 181 engaging the front ends 188 of the blade springs 186. Such engagement results in the front edge 181, due to the chamfer thereof, deflecting the front ends 188 outward such that the front edge 181 becomes positioned radially inward relative to the front ends 188.

The tension limiting mechanism 164 further includes a regulator ring 199 which is located within the regulator grip 50 in coaxial relation therewith as shown in FIG. 6. The regulator ring 199 has diametrically opposed openings 205, 207 through which extend respective pins 201, 203. The upper and lower pins 201, 203 also extend into respective helical slots 56, 58 to couple the regulator ring 199 to the regulator grip 50. This coupling provides for rotation of the regulator grip 50 to produce longitudinal translation of the regulator ring 199 relative thereto. The regulator ring 199 has a pair of diametrically opposed lateral recesses 208 in the rear edge thereof.

The tension limiting mechanism 164 further includes a control ring 209 which encircles the blade springs 186 in transverse relation thereto. The control ring 209 can be longitudinally displaced relative to the blade springs 186. This longitudinal displacement is controlled by the connection of the control ring 209 to the regulator ring 199. The connection is provided by lateral ears 211 which extend outwardly from the control ring 209, as shown in FIG. 9. The lateral ears 211 are fixed to the corresponding lateral recesses 208 in the regulator ring 199. This results in longitudinal displacement of the regulator ring 199 producing corresponding longitudinal displacement of the control ring 209. Such displacement of the regulator ring 199 is provided by rotation of the regulator grip 50, and the coupling therebetween provided by the upper and lower pins 201, 203.

The engagement of the control ring 209 against the blade springs 186 has sufficient inward force to establish the respective engagements as the fulcrums 213 about which the portions of the blade springs to the front of the engagements may be deflected. Consequently, the respective fulcrums 213 are longitudinally displaced relative to the blade springs 186 by longitudinal displacement of the control ring 209 which is produced by corresponding longitudinal displacement of the regulator ring 199. As a result, rotating the regulator grip 50, which produces corresponding longitudinal displacement of the regulator ring 199, due to the coupling therebetween provided by the upper and lower pins 210, 203, will vary the resistance to deflection of the respective portions of the blade springs 186 to the front of the corresponding fulcrums 213 since such resistance increases as the fulcrums are longitudinally displaced toward the front of the corresponding blade springs.

The tension and anti-recoil mechanism 10 includes upper and lower indexing pins 215, 217 which extend through respective openings in the rear housing ring 164 and into the longitudinal recesses between the splines 81 of the cutter actuator 70. Such extension of the pins 215, 217 prevents relative rotation of the cutter actuator 70 relative to the rear housing ring 164. The pins 215, 217 are spring-loaded such that application of a sufficient rotation force to the cutter actuator 70 will causes the pins to retract from the longitudinal recesses between the splines 81 allowing rotation of the cutter actuator. When the rotation force is removed, the spring-loading of the pins 215, 217 forces the pins into the longitudinal recesses between the splines 81 to prevent further rotation of the cutter actuator 70.

The rear of the pull rod 92 is press-fitted to a pull rod yoke 220 having a transverse yoke web 222 and a pair of yoke flanges 224 extending rearward from the yoke web. The rear of pull rod yoke 220 is closed by a pull rod pin 226 which extends between the yoke flanges 224. The detent 47 of the rod link 37 is inserted within the pull rod yoke 220 so that the detent is forward of the pull rod pin 226 and thereby longitudinally fixed relative to the pull rod 92, as shown in FIGS. 6 and 7. Accordingly, the pull rod 92 is axially displaced relative to the tool handle 22 when the rod link 37 is pivoted in the directions 43, 45.

In operation, the trigger mechanism 35 is released allowing the cutter actuator spring 90 to urge the cutter actuator 70 in the forward direction relative to the regulator grip 50 such that the rear edge of the key window 74 engages the key 108 of the rear lock washer 96 for translation of the central portion 100 thereof into engagement with the central portion 98 of the front lock washer 94. Continuing such forward insertion of the cutter actuator 70 causes the outer portion of the key 106 of the front lock washer 94 to be forced against the rear end of the front ring 85 resulting in the front and rear lock washers 94, 96 being pivoted about the key window 74 to the released positions 114, 116. As a result, the central portions 98, 100 of the lock washers 94, 96 have a perpendicular orientation relative to the longitudinal axis of the cutter actuator 70 such that a sufficient radial clearance is established between the apertures 102, 104 of the lock washers and the pull rod 92 to allow longitudinal translation thereof relative to the lock washers.

The regulator grip 50 may be rotated about the longitudinal axis thereof relative to the barrel 27 to set the maximum tension to be applied to the cable tie by the cable tie tool 12. Such rotation of the regulator grip 50 longitudinally displaces the respective fulcrums 213 of the corresponding blade springs 186.

The trigger mechanism 35 is pivoted such that the rod link 37 is pivoted in the direction 52 toward the open position. This causes the detent 47 to translate forwardly and, through the coupling thereof with the pull rod yoke 220, forwardly displace the pull rod 92. This, in turn, forwardly displaces the pawl cage 121 which causes the pawl grip 124 to pivot to the open position, an example of which is disclosed in U.S. Pat. No. 5,915,425 at column 8, lines 3 to 19 and FIGS. 7, 7*a* and 7*b*.

The cable tie 15 is positioned for tensioning by positioning the end of the strap 17 thereof, after the strap has been inserted through the head 20 of the cable tie, forward of the nose bracket 138 such that the end of the strap is to the rear of the head. The end of the strap 17 is displaced rearward such that it traverses above the upper edge of the nose bracket 138 and blade 142 into the pawl cage 121, for example, as shown in U.S. Pat. No. 5,915,425 at FIG. 10. The strap 17 is inserted into the pawl cage 121 sufficiently such that the head 20 of the cable tie 15 has a generally abutting relation with the front edge of the nose bracket 138, for example, as shown in U.S. Pat. No. 5,915,425 at FIG. 10.

The trigger mechanism 35 and grip 25 are then grasped between the fingers and palm of the hand of the user and squeezed therebetween causing the rod link 37 to pivot in the direction 54 toward the closed position. This, in turn, causes rearward displacement of the detent 47 which, through the coupling thereof with the pull rod yoke 220, displaces the pull rod 92 rearward.

Rearward displacement of the pull rod 92 is resisted by the pull rod spring 132 which is compressed thereby. Rearward displacement of the pull rod 92 results in the pawl cage 121, connected to the forward end of the pull rod, to be displaced rearward relative to the nose bracket 138. This causes the pawl grip 124 to pivot to the closed position for example, as disclosed in U.S. Pat. No. 5,915,425 at FIGS. 7*a* and 7*b*, resulting in the strap 17 being gripped by and thereby longitudinally fixed to the pawl assembly 119.

The squeezing of the trigger mechanism 35 is continued causing longitudinal displacement of the pawl assembly 119, and the strap 17 gripped therein, in the rearward direction. This results in the portion of the strap 17 which is gripped by the pawl assembly 119 being displaced rearward which initially causes the head 20 of the cable tie 15 to be drawn rearward into tight engagement with the front surface of the nose bracket 138. Continued rearward displacement of this portion of the strap 17 draws the strap rearward through the forward slot 72 thereby increasing the tension in the portion of the strap which is forward of the pawl assembly 119.

To increase the tension in the strap 17 to the required amount, a series of complete pivots of the trigger mechanism 35 toward the grip 25 may be required. Each such complete pivot of the trigger mechanism 35 results in the pull rod 92 and pawl assembly 119 attached thereto translating rearward the full extent. After each such translation, the user releases the trigger mechanism 35 allowing the pull rod spring 132 to urge the pull rod 92 forward. This results in the pawl grip 124 releasing the strap 17 of the cable tie 15 allowing the pawl assembly 119 to translate forward relative to the forward slot 72 while the strap 17 remains generally stationary therein. The pull rod 92 is returned by the pull rod spring 132 to its forward position thereby returning the trigger mechanism 35 to its open position from which it may again be closed to further increase the tension in the strap 17.

The tensioning of the strap 17 of the cable tie 15 produced by repeated closures and openings of the trigger mechanism 35 is limited by the tension and anti-recoil mechanism 10. More specifically, the tension force applied to the strap 17 of the cable tie 15 by the pull rod 92 is also applied to the nose bracket 138 through the portion of the strap which is forward of the pawl assembly 119 and the head 20. Thus, tensioning of the cable tie 15 results in a rearward force being applied to the nose bracket 138 which, in turn, urges rearward displacement of the cutter actuator 70 relative to the regulator grip 50 and tool handle 22. This relative displacement is resisted by the engagement of the front edge 181 of the front spring support 181 with the front ends 188 of the blade springs 186. If the front edge 181 is displaced to the rear of the front ends 188, further rearward displacement of the front edge 181 is resisted by the stiffness of the blade springs since such further rearward displacement requires increasing outward deflection of the blade springs.

If the rearward force applied to the cutter actuator 70 by the nose bracket 138, which results from the tension force applied to the cable tie 15 by the pull rod 92, is not sufficient to overcome the resistance of the blade springs 186, then the front edge 181 remains to the front of the front ends 188 and the cutter actuator is not displaced rearward relative to the regulator grip 50 and tool handle 22. Consequently, the tension force applied to the cable tie 15 by the pull rod 92 results in rearward displacement of the pawl assembly 119 relative to the nose bracket 138 thereby increasing the tension in the portion of the strap 17 which is forward of the pawl assembly.

As the tension in the portion of the strap 17 which is forward of the pawl assembly 119 increases, the strap increasingly resists further rearward displacement of the pawl assembly. Consequently, greater force must be applied by the hand of the user to pivot the trigger mechanism 35 toward the grip 25 which results in a larger force urging the pull rod 92 in the rearward direction. Normally, this force eventually becomes sufficiently large to overcome the resistance of the blade springs 186. As a result, the front edge 181 is displaced rearwardly thereby deflecting the blade springs 186 outwardly resulting in the front spring support 179 and cutter actuator 70 connected thereto to translate rearward relative to the regulator grip 50 and tool handle 22. The outward deflection of the blade springs 186 is facilitated by the chamfer of the front edge 181 which has the effect of a ramp. Thus, the resistance provided by the blade springs 186 limits the tensioning of the cable tie 15 since application of a rearward force to the pull rod 92 beyond a certain limit will result in the rearward relative translation of the cutter actuator 70 rather than rearward displacement of the pawl assembly 119 relative to the nose bracket 138.

Rearward translation of the cutter actuator 70 relative to the regulator grip 50 results in rearward translation of the cutter actuator away from the front ring 85 causing actuation of the lock washers 94, 96. More specifically, rearward translation of the cutter actuator 70 results in the front edge of the key window 74 engaging the key 106 of the front lock washer 94 causing carrying thereof and corresponding rearward translation of the lock washer 94 away from the front ring 85 which is longitudinally fixed relative to the regulator grip 50. Such rearward translation of the front lock washer 94 results in corresponding rearward translation of the rear lock washer 96.

During such rearward translation of the lock washers 94, 96, the central portion 98 of the front lock washer 94 is subjected to the force of the pull rod spring 132 which urges the central portion 98 rearward relative to the cutter actuator 70. Such urging by the pull rod spring 132 results in pivoting of the front lock washer 94 about the key 106. Such pivoting of the front lock washer 94 produces corresponding pivoting of the rear lock washer 96 about the key 108. As a result, the central portions 98, 100 of the lock washers 94, 96 become tilted relative to the longitudinal axis of the cutter actuator 70. These tilted positions of the central portions 98, 100 cause engagement thereof with the pull rod 92 where such engagement has sufficient force such that the central portions become frictionally locked to the pull rod. Such locking prevents rearward displacement of the pull rod 92 relative to the lock washers 94, 96. The lock washers are prevented from further rearward displacement relative to the cutter actuator 70 because of the engagement of the key 108 of the rear lock washer 96 with the rear edge of the key window 74, and the engagement of the rear lock washer by the front lock washer 94. Consequently, the frictional locking of the central portions 98, 100 to the pull rod 92 prevents rearward displacement thereof relative to the cutter actuator 70, and locks the pull rod 92 in the rearward direction relative to the cutter actuator 70.

Locking of the pull rod 92 in the rearward direction results in the lock washers 94, 96 providing a coupling between the pull rod and cutter actuator 70 such that continued rearward displacement thereof causes rearward displacement of the cutter actuator. This coupling substantially replaces the coupling between the pull rod 92 and cutter actuator 70 provided by the tensioned cable tie 15. The tensioned cable tie 15 enables the initial rearward displacement of the cutter actuator 70 relative to the regulator grip 50 and front ring 85 which results in the prior pivoting of the lock washers 94, 96. This reduces the re-coil of the pull rod 92 and trigger mechanism 35 when the strap 17 of the cable tie 15 is severed by the cutter mechanism 134.

Continued rearward displacement of the pull rod 92, lock washers 94, 96 and cutter actuator 70 relative to the regulator grip 50 results in rearward displacement of the cutter bracket 136 relative to the cutter arm 147. This relative displacement results from the cutter bracket 136 being longitudinally fixed by the pin 140 to the cutter actuator 70 and the foot 155 of the cutter arm 147 being inserted in the recess 86 of the front ring 85, as shown in FIG. 6. This relative displacement results in upward pivoting of the cutter bracket 136 because of the coupling thereof provided by the cutter link 157 to the cutter arm 147. Such upward pivoting of the cutter bracket 138 produces upward displacement of the cutter blade 142 which severs the strap 17 of the cable tie 15 which extends through the nose bracket 138 above the cutting edge 144.

The re-coil which may result from the severing of the strap 17 is substantially eliminated by the tensioning and anti-recoil mechanism 10. In contrast, without the tensioning and anti-recoil mechanism 10, the severing of the strap 17 may result in a sudden and substantial reduction in the force which resists rearward displacement of the pawl assembly 119, in which the strap 17 is gripped, and the pull rod 92 which is connected to the pawl assembly. Such a sudden and substantial reduction in the resistance force typically results in a sudden and substantial reduction in the force which resists closure of the trigger mechanism 35 and grip 25 between the fingers and palm of the hand of the user, which causes a sudden and substantial re-coil of the cable tie tool 12 experienced by the user thereof. Such a re-coil typically results if the rearward displacement of the pull rod 92 produces corresponding rearward displacement of the cutter actuator 70 through a coupling provided by the cable tie 15.

The re-coil which may result from the severing of the strap 17 is substantially eliminated by the tensioning and anti-recoil mechanism 10 because the severing of the strap 17 does not result in a sudden and substantial reduction of the force which resists rearward displacement of the pull rod 92. This substantial elimination of the re-coil results from the force resisting rearward displacement of the pull rod 92 being provided by the cutter actuator spring 90 between the cutter actuator 70 and regulator grip 50. Also, the coupling between the pull rod 92 and cutter actuator 70 is provided by the tilting engagement and frictional locking between the lock washers 94, 96 and pull rod 92 of the tension and anti-recoil mechanism 10, rather than the tensioned cable tie 15.

After the severing of the strap 17 by the cutter mechanism 134, the hand of user releases the trigger mechanism 35 allowing pivoting thereof away from the grip 25. Such pivoting is caused by the forward displacement of the cutter actuator 70 relative to the regulator grip 50 which results from the urging of the cutter actuator spring 90. Such displacement of the cutter actuator 70 causes the rear edge of the key window 74 to carry the key 108 of the rear lock washer 96 forward into forced engagement with the key 106 of the front lock washer 94. The key 106 is thereby carried forward into forced engagement with the rear edge of the front ring 85. This results in the central portions 98, 100 of the lock washers 94, 96 pivoting about the respective keys 106, 108 from the tilted orientation relative to the longitudinal axis of the pull rod 92 to a perpendicular orientation relative thereto. Such pivoting results from the keys 106, 108 being forced into a perpendicular orientation relative to the longitudinal axis of the pull rod 92 between the rear edge of key window 74 and the rear edge of the front ring 85. Pivoting of the central portions 98, 100 from the tilted to perpendicular orientations releases the frictional locking between the central portions 98, 100 and pull rod 92 allowing longitudinal displacement of the pull rod relative to the lock washers 94, 96. Also, such pivoting of the central portions 98, 100 from the tilted to perpendicular orientations is resisted by the pull rod spring 132. The pawl assembly 119 and cutter actuator 70 are thereby returned to the respective most forward positions thereof relative to the cutter actuator and regulator grip 50, respectively, by the pull rod spring 132 and cutter actuator spring 90. The cable tie tool 12 is thereby readied for the strap 17 of a new cable tie 15 to be inserted therein for tensioning and cutting thereof.

The tension and anti-recoil mechanism 10 operates according to methods which provide for automatic functioning of substantial portions of the mechanism thereby simplifying the operations required of the user to facilitate use of the cable tie tool 12.

The tension and anti-recoil mechanism 10, as shown in FIG. 9, includes two lock washers 94, 96 and four blade springs 186. Such a tension and anti-recoil mechanism 10 may limit the tension in the cable tie 15 to 120 lbs. Alternatively, the tension and anti-recoil mechanism 10 may include a single lock washer, such as 94 or 96, and two blade springs 186 for limiting the tension in the cable tie 15 to 50 lbs.

An alternative embodiment of the cable tie tool 12*a* is shown in FIGS. 10 to 18. FIGS. 10 to 14, and 16 to 18 are views which correspond to the views of FIGS. 1 to 7, respectively. Parts shown in FIGS. 10 to 14, and 16 to 18 which correspond to parts shown in FIGS. 1 to 7 have the same reference numeral as in FIGS. 1 to 7 with the addition of the suffix "a" in FIGS. 10 to 14, and 16 to 18. The tension and anti-recoil mechanism 10*a* is generally the same as the tension and anti-recoil mechanism 10 shown in FIGS. 1 to 7. The tool handle 22*a* shown in FIGS. 10 to 14 includes a trigger mechanism 228 as shown in FIGS. 10 to 12, 16 and 18.

Figure 8:
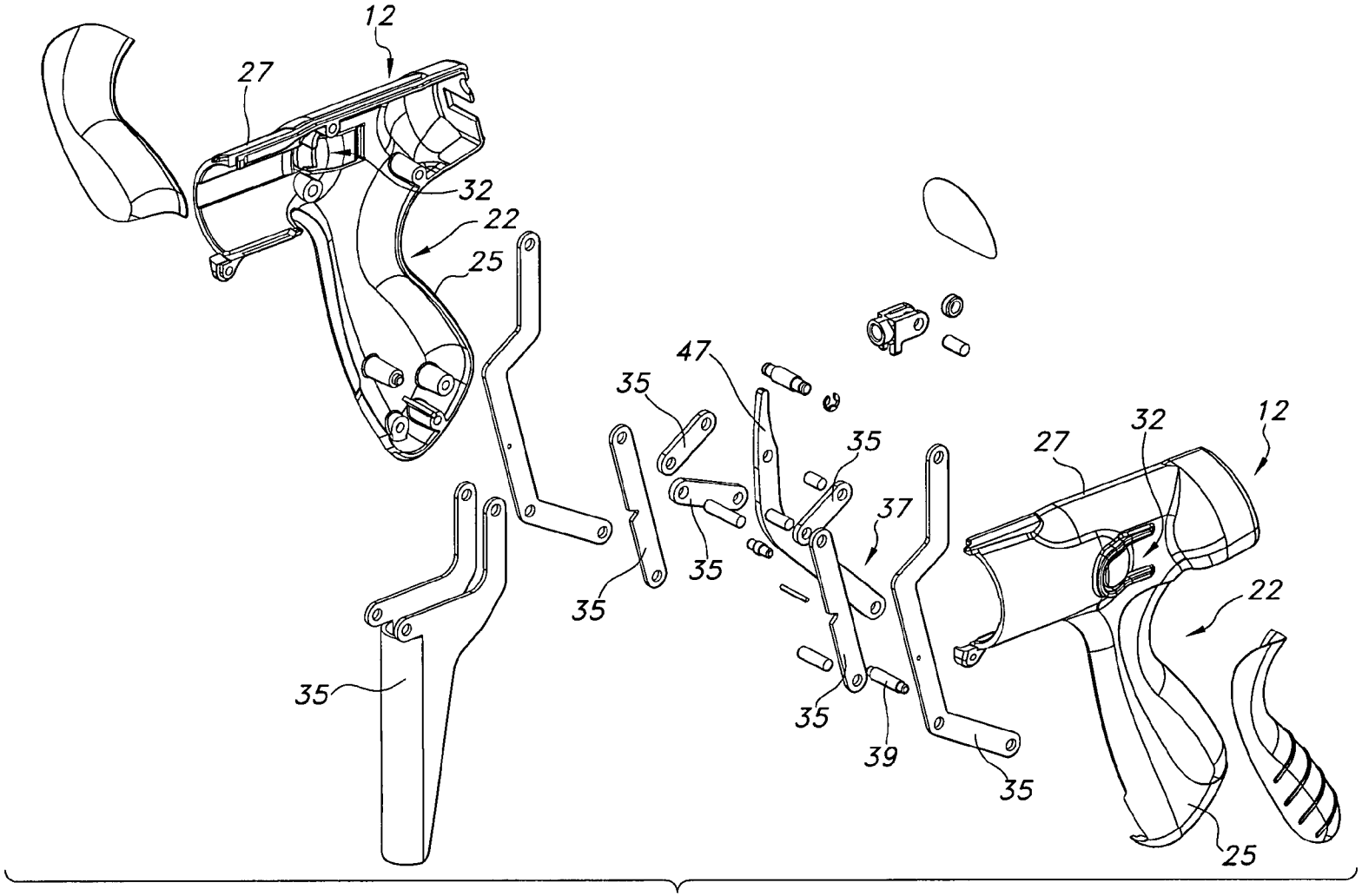
FIG. 8 is an exploded view of the tool handle of FIG. 1 showing the linkage located within the tool handle.
Figure 28:
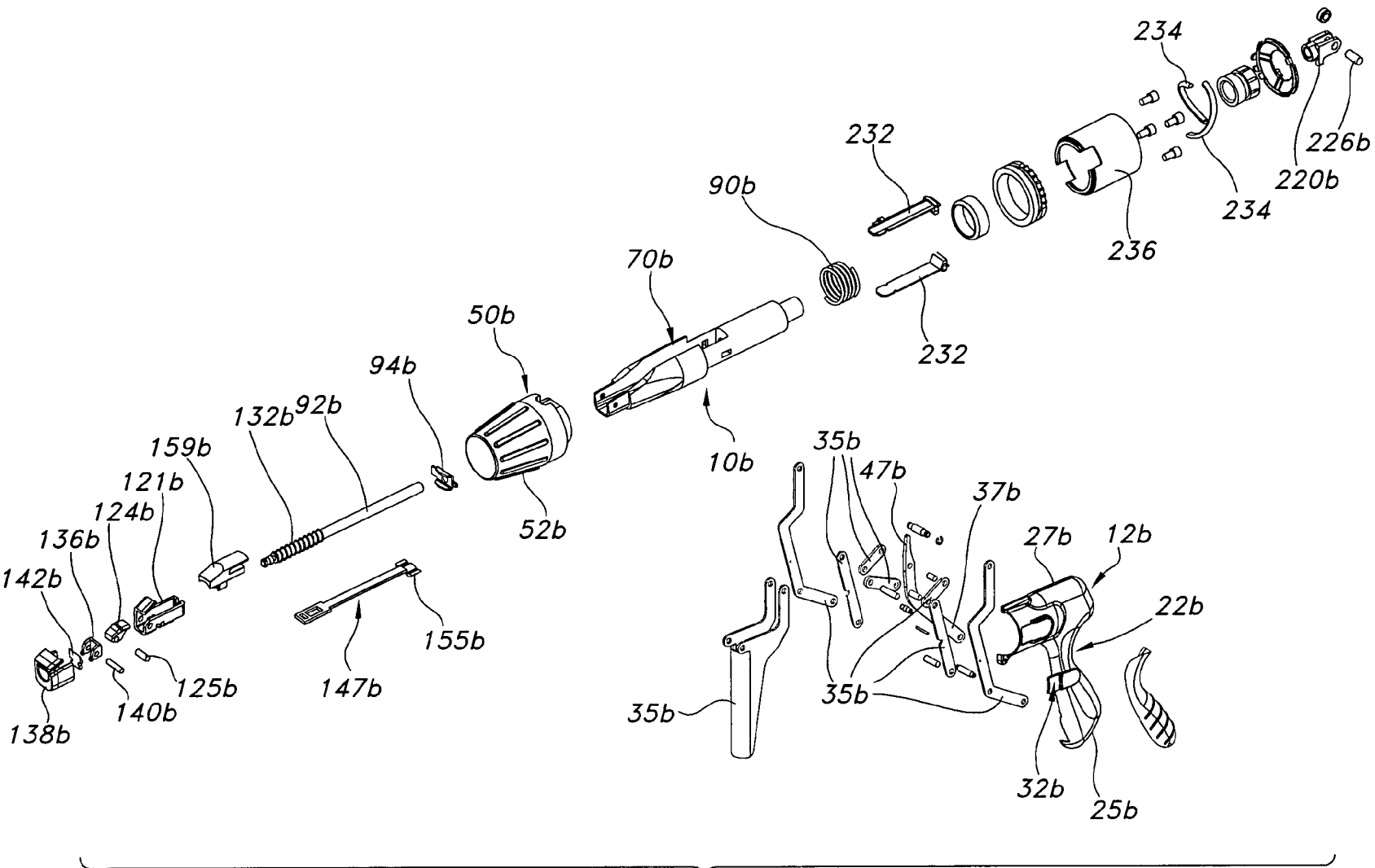
FIG. 28 is an exploded view of the tension and anti-recoil mechanism, trigger mechanism and the left side of the grip and barrel of FIG. 19, showing components within the tension and anti-recoil mechanism and tool handle.
Figure 29:
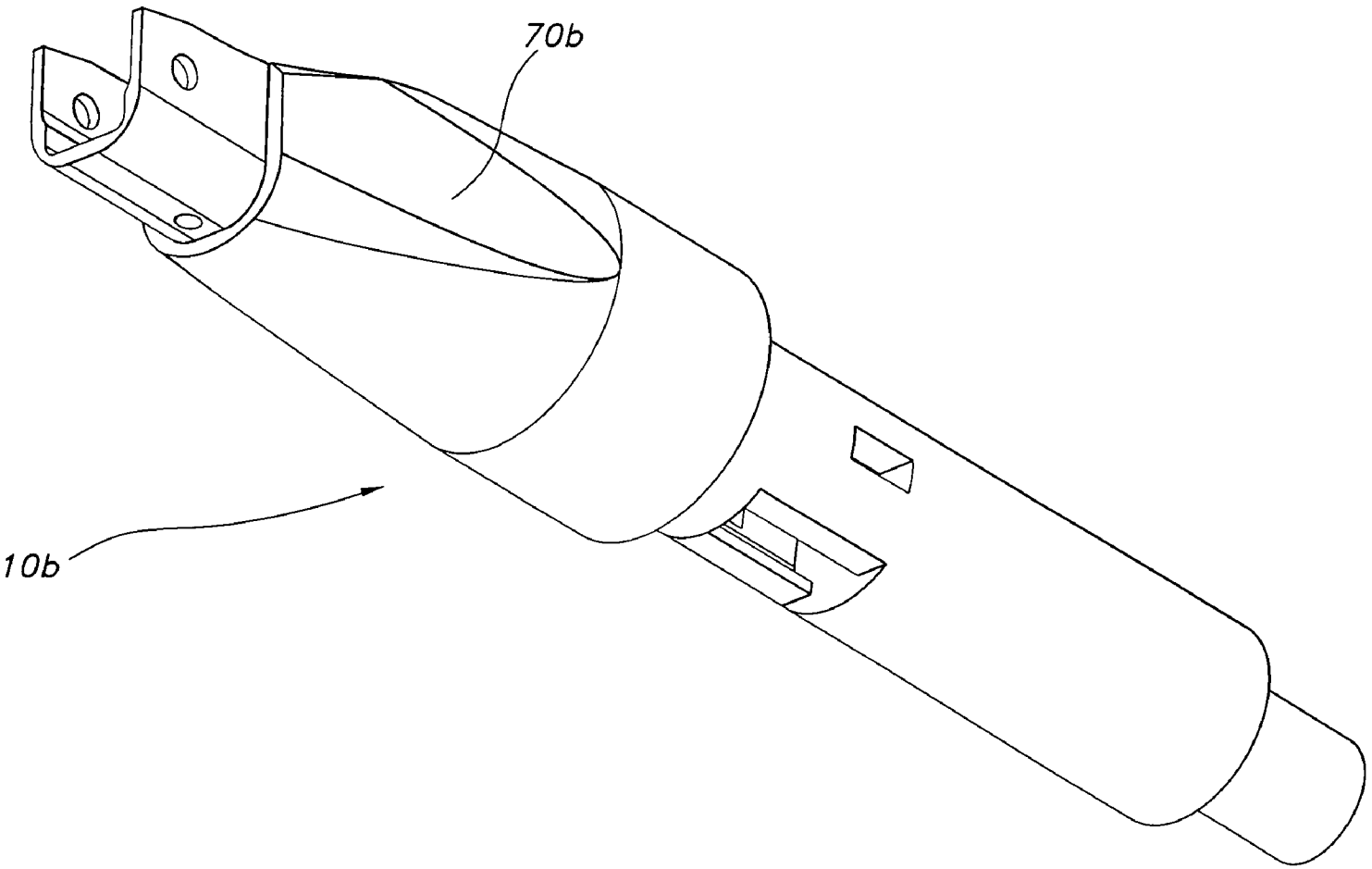
FIG. 29 is a perspective view of the side and bottom of the cutter actuator of FIG. 28.
Figure 30:
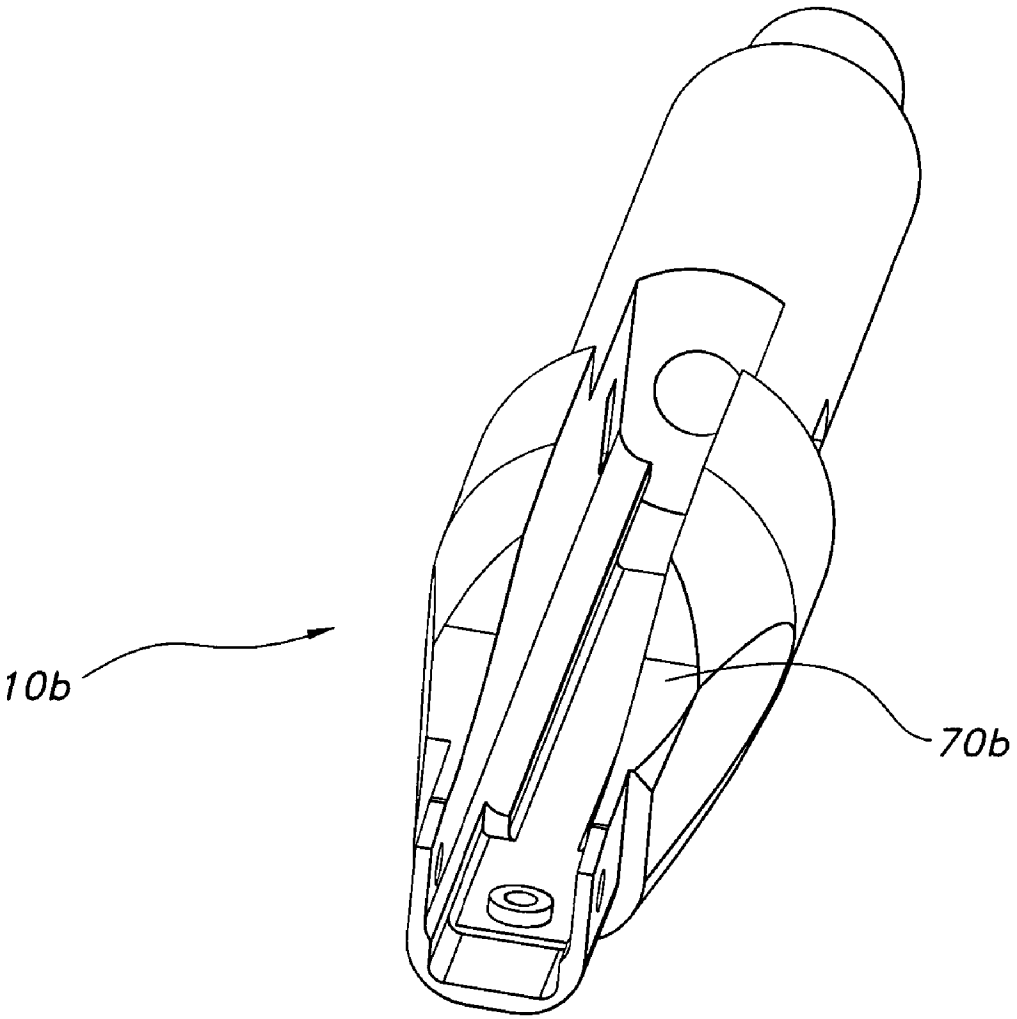
FIG. 30 is a perspective view of the top of the front portion of the cutter actuator of FIG. 28.
Figure 31:
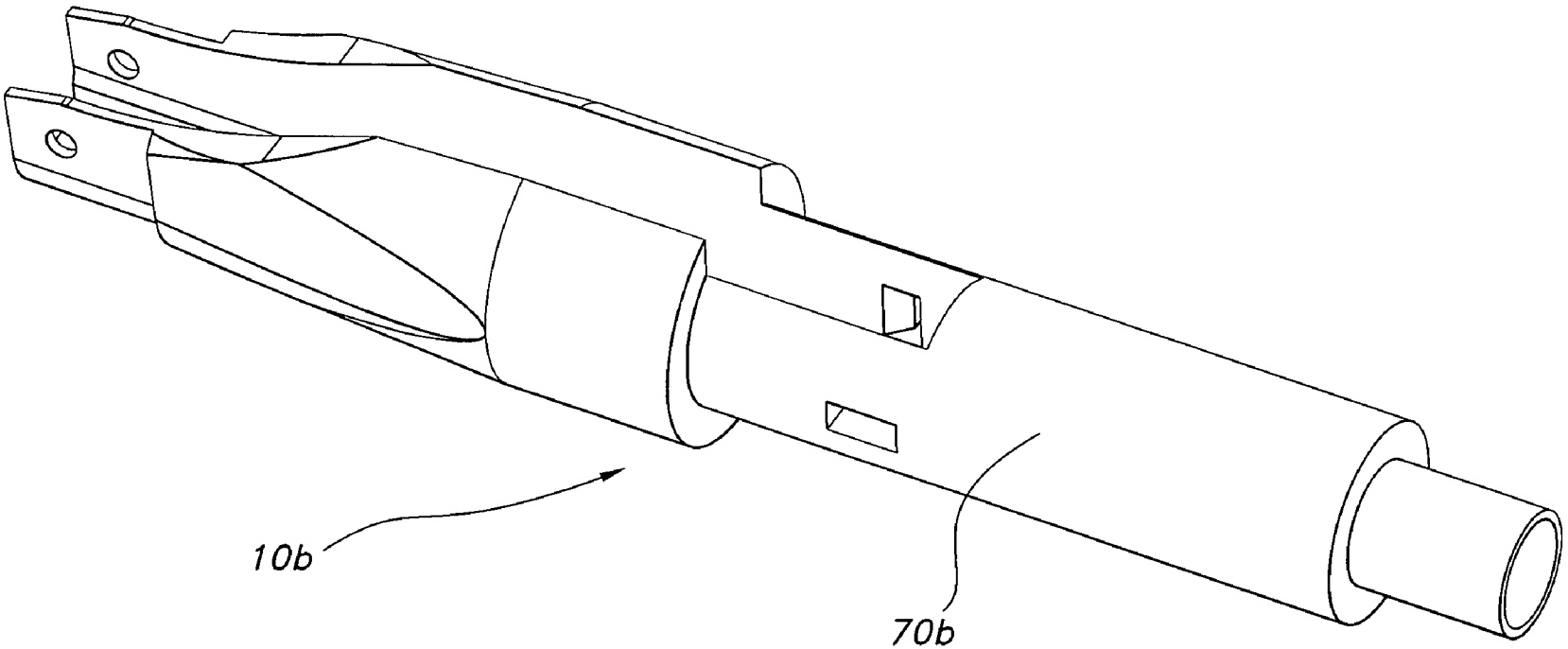
FIG. 31 is an enlarged perspective view of the side and top of an intermediate portion of the cutter actuator of FIG. 28.
Figure 32:
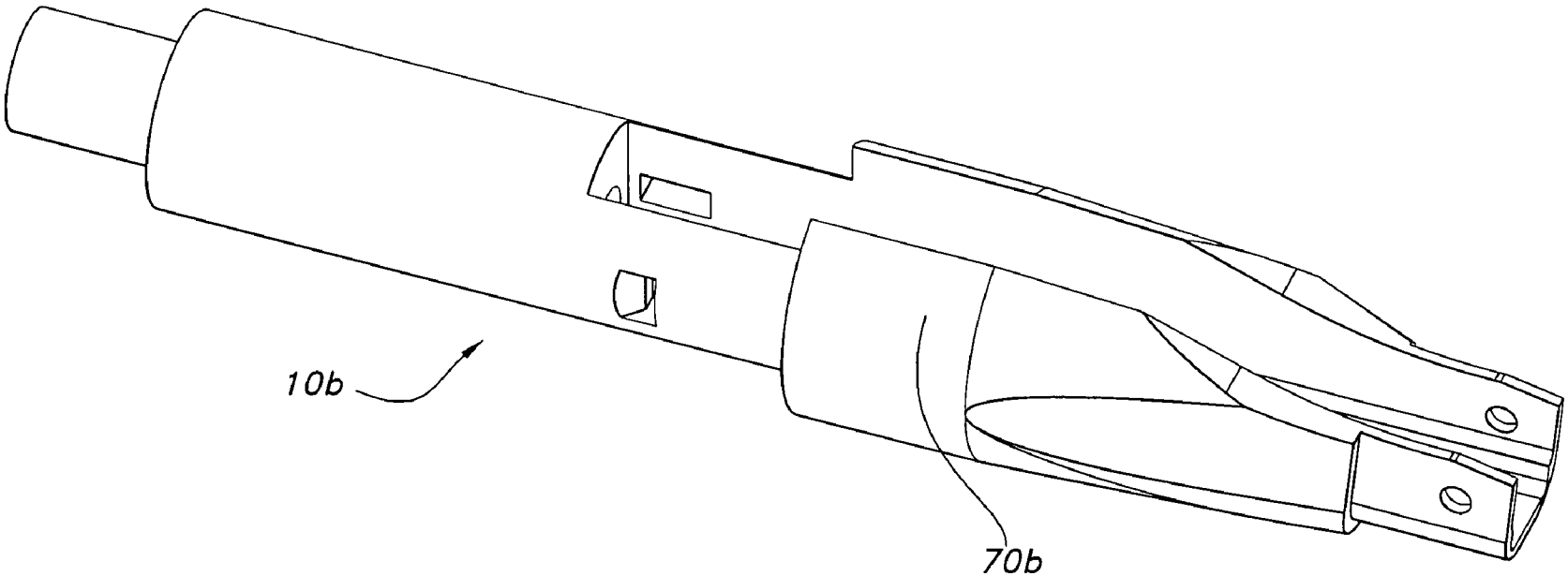
FIG. 32 is an enlarged perspective view of the side and top of an intermediate portion of the cutter actuator of FIG. 28, showing the side which is opposite to the side of FIG. 31.
Figure 33:
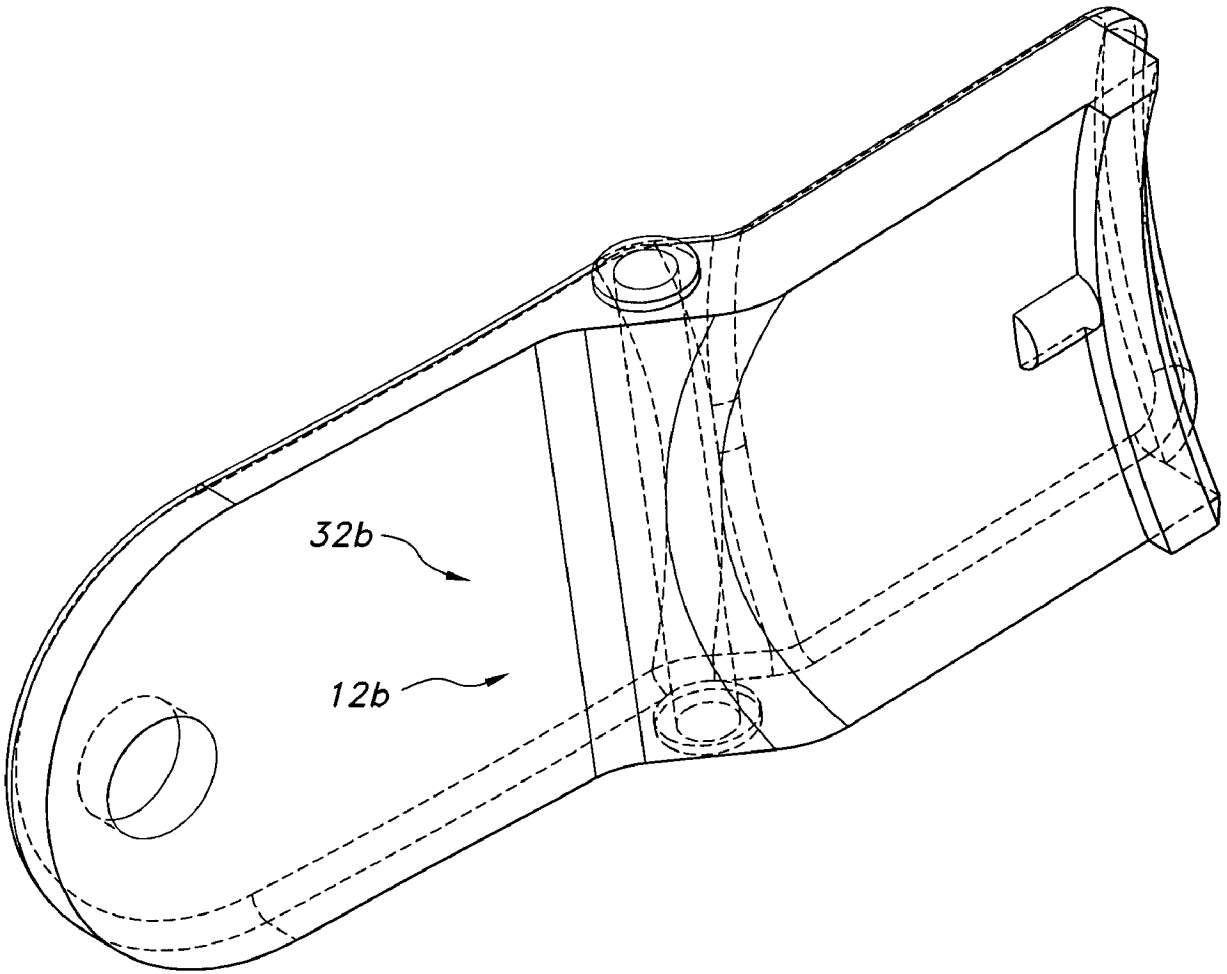
FIG. 33 is an enlarged perspective view of the latch mechanism of FIG. 28, showing the inner surfaces of the latch mechanism.

A further alternative embodiment of the cable tie tool 12*b* is shown in FIGS. 19 to 33. FIGS. 19 to 22, 26, and 24 are views which correspond to the views of FIGS. 1 to 7, respectively. FIG. 28 is a view which corresponds to the views of FIGS. 8 and 9. Parts shown in FIGS. 19 to 33 which correspond to parts shown in FIGS. 1 to 7, 8 and 9 have the same reference numeral as in FIGS. 1 to 7, 8 and 9 with the addition of the suffix "b" in FIGS. 19 to 33. The tool handle 22*a* shown in FIGS. 19, 20, 23, 26 and 28 is generally the same as the tool handle 22 shown in FIGS. 1 to 3, 6 and 8. In general, the tension and anti-recoil mechanism 10*b* shown in FIGS. 19 to 33 corresponds to the tension and anti-recoil mechanism 10. The tension and anti-recoil mechanism 10*b* differs from the tension and anti-recoil mechanism 10 in some respects. For example, the tension and anti-recoil mechanism 10 includes a cutter actuator 70 against which a transverse force is directed by the blade springs 186. A corresponding transverse force is directed against the cutter actuator 70*b* of the tension and anti-recoil mechanism 10*b*. However, the transverse force directed against the cutter actuator 70*b* is produced by leaf springs 232.

Another difference between the tension and anti-recoil mechanisms 10, 10*b* is the mechanism for longitudinally displacing the respective fulcrums 213, 213*b* of the blade springs 186 and leaf springs 232. Such displacement of the fulcrums 213 in the tension and anti-recoil mechanism 10 is provided by a control ring 209. The tension and anti-recoil mechanism 10*b* includes a pair of arcuate members 234 which are inclined relative to the leaf springs 232. The arcuate members 234 are secured to a ring 236 and are forcibly directed inwardly against the leaf springs 232 to establish the fulcrums 213*b*. Rotation of the ring 236 provides the longitudinal displacement of the fulcrums 213*b*.

The entire disclosure of U.S. Pat. No. 5,915,425 issued Jun. 29, 1999 is hereby incorporated by reference herein. The entire disclosures of U.S. patent application Ser. No. 10/614,435 filed in the USPTO on Jul. 7, 2003, U.S. patent application Ser. No. 29/185,985 filed in the USPTO on Jul. 7, 2003 and U.S. patent application Ser. No. 29/185,986 filed in the USPTO on Jul. 7, 2003 are each hereby incorporated by reference herein. The entire disclosures of U.S. Provisional Patent Application No. 60/544,361 filed in the USPTO on Feb. 13, 2004, U.S. Provisional Patent Application No. 60/544,362 filed in the USPTO on Feb. 13, 2004, and U.S. Provisional Patent Application No. 60/544,472 filed in the USPTO on Feb. 13, 2004 are each hereby incorporated by reference herein. The entire disclosure of the U.S. patent application Ser. No. 11/055,929 filed in the USPTO on even date herewith and entitled "Cable Tie Tool Having Modular Tool Head", having as the inventor Joey D. Magno, Jr., Johan Tapper, Anders Fahlen, Joakim Norin, Goran Paulsson and Sven Wadling, is hereby incorporated by reference herein. The entire disclosure of the U.S application Ser. No. 11/055,929 filed in the USPTO on even date herewith and entitled "Cycle Counter for Cable Tie Tool", having as the inventor Joey D. Magno, Jr., is hereby incorporated by reference herein.

While the invention has been described by reference to certain preferred embodiments, it should be understood that numerous changes could be made within the spirit and scope of the inventive concept described. Accordingly, it is intended that the invention not be limited to the disclosed embodiments, but that it have the full scope permitted by the language of the following claims.

What is claimed is:

1. A tension and anti-recoil mechanism connected to a tool handle of a cable tie tool, the tool handle having a barrel and a grip depending therefrom, said tension and anti-recoil mechanism comprising:

a one-piece cutter actuator having an internal longitudinal pathway for longitudinal displacement of a pull rod therein, said cutter actuator being supported in the barrel for longitudinal displacement therein, said cutter actuator having an upwardly opening longitudinal forward slot; and a tension limiting mechanism supported in the barrel and longitudinally fixed relative to the barrel, said tension limiting mechanism being coupled to said cutter actuator and located outward thereof between the front and rear ends of said cutter actuator, said tension limiting mechanism applying a retaining force to said cutter actuator in a transverse direction relative to said cutter actuator to resist longitudinal displacement of said cutter actuator relative to the barrel.

2. A tension and anti-recoil mechanism according to claim 1, wherein said forward slot is sized to support a lock washer therein, said lock washer having a central aperture through which the pull rod extends, said lock washer being moveable to a released position which allows displacement of the pull rod relative to said cutter actuator, said lock washer being further moveable to a locked position in which said lock washer engages said pull rod to prevent displacement thereof relative to said cutter actuator.

3. A tension and anti-recoil mechanism according to claim 1, wherein said cutter actuator has front and rear ends and a sufficient longitudinal dimension such that a blade spring of the tension limiting mechanism for providing the retaining force can be positioned relative to said cutter actuator such that the entire blade spring is located longitudinally between said front and rear ends of said cutter actuator.

4. A tension and anti-recoil mechanism connected to a tool handle of a cable tie tool, the tool handle having a barrel and a grip depending therefrom, said tension and anti-recoil mechanism comprising:

a pull rod;

a cutter actuator having an internal longitudinal pathway in which said pull rod is supported for longitudinal displacement thereof through the pathway, said cutter actuator being supported in the barrel for longitudinal displacement therein;

a lock washer carried by said cutter actuator such that said lock washer may be pivoted between a released position within said pathway in perpendicular relation to said pathway and a locked position within said pathway in tilted relation to said pathway, said lock washer having an aperture through which the pull rod extends such that the pull rod is displaceable through said lock washer in said released position, said lock washer frictionally locking the pull rod to prevent displacement thereof through said lock washer when in said locked position; and a front ring located externally of said cutter actuator in coaxial relation therewith, said front ring being positioned longitudinally relative to said lock washer such that said front ring provides a surface against which said lock washer abuts when in said released position, said lock washer being pivoted to said locked position when said cutter actuator is longitudinally displaced relative to said front ring to a position which allows a tilting relation of said lock washer relative to said surface of said front ring.

5. A tension and anti-recoil mechanism connected to a tool handle of a cable tie tool, the tool handle having a barrel and a grip depending therefrom, said tension and anti-recoil mechanism comprising:

a cutter actuator supported in the barrel for longitudinal displacement therein; and an elongate blade spring having one end which is fixed to the tool handle in longitudinal relation to said cutter actuator, said blade spring having another movable end which engages the outer surface of said cutter actuator to obstruct longitudinal displacement of said cutter actuator relative to said barrel, said blade spring being deflectable away from said cutter actuator in a transverse direction relative to said cutter actuator for disengagement therefrom to allow longitudinal displacement of said cutter actuator relative to the barrel, said blade spring having sufficient stiffness to prevent said disengagement of said blade spring from said cutter actuator when a longitudinal force below a limit is applied to said cutter actuator, said blade spring having sufficient flexibility to allow said transverse deflection of said blade spring away from said cutter actuator to allow said disengagement of said blade spring from said cutter actuator when a longitudinal force above said limit is applied to said cutter actuator.

6. A tension and anti-recoil mechanism according to claim 5, and further comprising a control ring connected to said blade spring, said control ring applying a force to said blade spring between said ends thereof such that the engagement between said control ring and blade spring provides a fulcrum about which said movable end of said blade spring deflects, said control ring providing for longitudinal displacement of said fulcrum relative to said blade spring to change said stiffness thereof and the corresponding limit of the longitudinal force applied to said cutter actuator above which longitudinal displacement thereof relative to the barrel is produced.

7. A tension and anti-recoil mechanism according to claim 6, and further comprising a regulator grip located externally of said cutter actuator in coaxial relation therewith, said regulator grip having a helical slot which is coupled to said control ring such that rotation of said regulator grip about the longitudinal axis thereof causes longitudinal displacement of said control ring relative to said blade spring producing said longitudinal displacement of said fulcrum relative to said blade spring.

8. A tension and anti-recoil mechanism connected to a tool handle of a cable tie tool, the tool handle having a barrel and a grip depending therefrom, said tension and anti-recoil mechanism comprising:

a regulator grip supported in the barrel portion and longitudinally fixed relative to the barrel portion;

a cutter actuator supported in said regulator grip in coaxial relation therewith for longitudinal displacement therein; and a cutter actuator spring connected to said cutter actuator and regulator grip to resist longitudinal displacement of said cutter actuator relative to said regulator grip.

9. A tension and anti-recoil mechanism according to claim 8, wherein said cutter actuator spring is a helical spring having a coaxial relation to said cutter actuator and regulator grip, said cutter actuator spring being located within said regulator grip and externally of said cutter actuator.

10. A tension and anti-recoil mechanism connected to a tool handle of a cable tie tool, the tool handle having a barrel and a grip depending therefrom, said tension and anti-recoil mechanism comprising:

a cutter actuator supported in the barrel for longitudinal displacement therein;

an elongate leaf spring having one end which is fixed to the tool handle in longitudinal relation to said cutter actuator, said leaf spring having another movable end which engages the outer surface of said cutter actuator to obstruct longitudinal displacement of said cutter actuator relative to said barrel, said leaf spring being deflectable away from said cutter actuator in a transverse direction relative to said cutter actuator for disengagement therefrom to allow longitudinal displacement of said cutter actuator relative to the barrel, said leaf spring having sufficient stiffness to prevent said disengagement of said leaf spring from said cutter actuator when a longitudinal force below a limit is applied to said cutter actuator, said leaf spring having sufficient flexibility to allow said transverse deflection of said leaf spring away from said cutter actuator to allow said disengagement of said leaf spring from said cutter actuator when a longitudinal force above said limit is applied to said cutter actuator;

an arcuate member connected to said leaf spring in inclined relation to said leaf spring, said arcuate member applying a force to said leaf spring between said ends thereof such that the engagement between said arcuate member and leaf spring provides a fulcrum about which said movable end of said leaf spring deflects, said arcuate member providing for longitudinal displacement of said fulcrum relative to said leaf spring to change said stiffness thereof and the corresponding limit of the longitudinal force applied to said cutter actuator above which longitudinal displacement thereof relative to the barrel is produced; and a ring to which said arcuate member is secured such that rotation of said ring provides said longitudinal displacement of said fulcrum relative to said leaf spring.

* * * * *

UNITED STATES PATENT AND TRADEMARK OFFICE

CERTIFICATE OF CORRECTION

PATENT NO. : 7,231,944 B2
APPLICATION NO. : 11/056078
DATED : June 19, 2007
INVENTOR(S) : Magno, Jr. et al.

It is certified that error appears in the above-identified patent and that said Letters Patent is hereby corrected as shown below:

Column 1, line 45, delete "resulting a re-coil force being applied" and insert therefor --resulting in a re-coil force being applied--.

Column 1, lines 64-65, delete "The cutter actuator and is coupled provides support" and insert therefor --The cutter actuator should be as coupled--.

Column 2, line 15, delete "adjustment the retaining force" and insert therefor --adjustment of the retaining force--.

Column 5, line 2, delete "regulator gr tubular member" and insert therefor --regulator grip 50 defined by tubular member--.

Column 10, line 45, delete "will causes the pins to retract" and insert therefor --will cause the pins to retract--.

Signed and Sealed this

Eighth Day of April, 2008

Jon W. Dudas

JON W. DUDAS
*Director of the United States Patent and Trademark Office*